US008965024B2

(12) United States Patent
Graham

(10) Patent No.: US 8,965,024 B2
(45) Date of Patent: Feb. 24, 2015

(54) COMPACT LOW FREQUENCY AUDIO TRANSDUCER

(71) Applicant: Doug Graham, Redmond, WA (US)

(72) Inventor: Doug Graham, Redmond, WA (US)

( * ) Notice: Subject to any disclaimer, the term of this patent is extended or adjusted under 35 U.S.C. 154(b) by 0 days.

(21) Appl. No.: 14/085,363

(22) Filed: Nov. 20, 2013

(65) Prior Publication Data

US 2014/0140559 A1 May 22, 2014

Related U.S. Application Data

(60) Provisional application No. 61/728,418, filed on Nov. 20, 2012.

(51) Int. Cl.

| | |
|---|---|
| ***H04R 1/20*** | (2006.01) |
| ***H04R 9/06*** | (2006.01) |
| *H04R 25/00* | (2006.01) |
| *F01N 13/00* | (2010.01) |
| *H04R 1/28* | (2006.01) |

(52) U.S. Cl.

CPC ..... *H04R 9/06* (2013.01); *H04R 1/2811* (2013.01)

USPC ..... 381/345; 381/165; 381/186; 181/225

(58) Field of Classification Search

CPC ..... H04R 1/24; H04R 1/403; H04R 9/06; H04R 1/42

USPC ..... 381/86, 332, 335, 182, 186, 386, 389, 381/401, 433, 165, 166; 181/157, 144, 172, 181/163, 225–227

See application file for complete search history.

(56) References Cited

U.S. PATENT DOCUMENTS 5,191,618 A * 3/1993 Hisey ..... 381/165

* cited by examiner

*Primary Examiner* — Curtis Kuntz
*Assistant Examiner* — Sunita Joshi
(74) *Attorney, Agent, or Firm* — J.A. McKinney & Assoc., LLC

(57) ABSTRACT

A rotary reciprocating acoustic transducer for producing sound in response to an applied electrical signal has a ported tubular housing having a generally cylindrical chamber with an interior lumen which is generally symmetrical about a central axis and opposing first and second linear reciprocating electrodynamic motors mounted over the tubular housing member's first and second open end, with a reciprocating rotatable transducer vane assembly with first and second rotating vanes projecting radially away from a central, axially aligned shaft driven by the first and second linear reciprocating motors.

20 Claims, 19 Drawing Sheets

COMPACT LOW FREQUENCY AUDIO TRANSDUCER

REFERENCE TO PRIOR APPLICATIONS

This application claims the benefit of prior copending U.S. Provisional Application No. 61/728,418 filed Nov. 20, 2012, the entire disclosure of which is hereby incorporated herein by reference.

BACKGROUND OF THE INVENTION

1. Field of the Invention

The present invention relates to loudspeakers or audio transducers and more particularly to Subwoofers, as used in audio playback and sound reinforcement applications.

2. Discussion of the Prior Art

A great variety of moving coil loudspeaker transducer designs have been proposed for high quality, low frequency sound reproduction. Low frequency transducers or "woofers" are typically included in a modern full range loudspeaker system utilizing different transducers for different segments of the sound spectrum. For example, the "woofer" is used for bass or low frequencies, a mid-range speaker is used for intermediate frequencies and a "tweeter" is used for the highest frequencies in the reproduced spectrum.

It is generally accepted that loudspeakers with sufficient size to produce adequate bass have well understood limitations. In particular, high power signals driving the cone into extreme excursions cause poor sound reproduction when driven by more challenging audio signals.

Typical prior art woofers utilize circular baskets supporting and aiming a frusto-conical driver diaphragm having a circular peripheral edge carrying an annular surround or suspension. Customarily, the circular small end of the frustoconical diaphragm supports a cylindrical voice coil former upon which is wound a conductive voice coil having positive and negative terminal ends. Conventional woofers utilize baskets which closely follow the frustoconical shape of the driver diaphragm and support the motor magnet and the circular diaphragm surround in a co-axial alignment, permitting a piston-like axial reciprocating movement of the diaphragm in response to electrical excitation of the voice coil.

In some high-end automotive applications, music aficionados and auto-sound competitors will install several woofers in a two-dimensional array on a baffle or enclosure surface; for example, it may be desirable to install four or six woofers in two rows of two or three, so mounting space becomes a concern. Another concern for music aficionados and auto-sound competitors is woofer failure due to thermal or mechanical overloading problems. Substantial amounts of power are required to provide competition-winning sound pressure levels, often well over 150 decibels (dB). Signals having such power require very large current flow through voice coil conductors, thus generating substantial amounts of heat, and drive the woofers to extreme excursions, thus generating extreme mechanical loads on diaphragms and suspensions. These concerns have led to ever-larger and more robust pistonic, cone-diaphragm woofer designs, as described in U.S. Pat. No. 6,938,726 (Roark et al), among others.

The specific elements making up this typical woofer have a well-established nomenclature. As illustrated in FIGS. 1 and 2, a typical direct radiating pistonic, cone-diaphragm woofer like that shown in U.S. Pat. No. 6,938,726 includes an electro-dynamic motor 14 with stationary parts and moving parts supported by the stationary parts. Typically, a woofer 10 has a stationary basket 11 which terminates at the upper end or distally in rigidly supported basket front flange 12 forming an annular or circular planar mounting surface. At the proximal end of basket 11 is a second substantially planar annular surface adapted to receive and carry woofer motor 14.

The moving cone or diaphragm 16 has an upper or distal larger circular edge upon which is permanently affixed a flexible half roll surround 18. Basket 11 is preferably cast from a rigid material such as a metal, preferably aluminum. Basket front flange 12 preferably carries a substantially planar ridged gasket ring 19, which is attached thereto by a plurality of evenly spaced threaded fasteners 40 which are evenly spaced around and completely penetrate through gasket ring 19 and are threadably received in blind holes machined into basket front flange 12 to clamp cone assembly surround 18 between gasket ring 19 and basket front flange 12. Rigid gasket ring 19 also includes an additional eight through holes or apertures evenly spaced between the apertures receiving hex fasteners 40 to permit longer threaded fasteners to penetrate through gasket ring 19 and through front flange 12 so that woofer 10 can be mounted in a baffle or enclosure wall, as is customarily done. Thus, front flange 12 has eight evenly spaced apertures, which penetrate completely through the planar front flange and also are aligned with similarly sized apertures in rigid gasket ring 19. Moving or reciprocating cone 16 typically carries a substantially dome-shaped dust cap 20 having a circular outer peripheral edge affixed (e.g. by a glue joint) to an exterior cone surface and the dust cap covers and protects a tube-shaped or substantially cylindrical voice coil former 12 which is affixed to a small opening of cone 16.

As is customary, at least one electrically conductive voice coil 26 having two ends (plus and minus) is wound around voice coil former 24; the voice coil ends (plus and minus) are each electrically connected to a single terminal connector 28 by a releasable electrical connection. Optionally, first and second voice coils are wound on former 24, and each voice coil has its ends terminated in a single terminal connector 28, and so four terminal connectors 28 are mounted on basket 11. Each of the terminals is carried by and supported on a horizontal and planar flange incorporated into basket 11 and the connective portions of each of the terminal connectors are electrically insulated from the rigid basket material by the use of insulating spacers or terminal bases which align and support the basket terminal connectors 28. Woofer motor 14 also includes a magnetic circuit defined by a doughnut shaped or annular ring shaped planar front plate 30, which along with the pole piece 32 defines a magnetic gap to focus magnetic flux from magnet 36 across voice coil 26. A substantially planar and circular back plate 34 also provides part of the magnetic circuit, carries cylindrical pole piece 32 and provides structural support for magnet 36. An annular magnetic gap focusing the magnetic flux from magnet 36 is defined in the annular space between pole piece 32 and the circular opening in front plate 30. The annular gap has a radial extent sized to receive the voice coil former's thickness plus the voice coil's thickness to provide adequate clearance for the moving voice coil in the magnetic gap during operation.

In use, the prior art Woofer's magnetic gap defined by the annular space between pole piece 32 and the circular opening in front plate 30 can be an area of substantial high temperature and voice coil heat is carried away from Woofer 10 by an air pumping action which accompanies motion of spider 22 whereby hot air surrounding voice coil 26 is pumped out to the side through screened side vents 38 arrayed around the side of Woofer 10 and defined in basket 11 just above or distally from woofer motor 14. The woofer cone assembly 16 includes a flexible spider suspension member 22 permanently affixed to the small proximal opening of cone 16 in close proximity to the joint between cone 16 and voice coil former 24. Spider suspension 22 comprises at least one accordion-pleated doughnut shaped annular ring of treated fabric which is attached (at the inside diameter of the spider circular aperture) to voice coil former 24 and cone 16 and (at the spider outer peripheral edge) carries a rigid spider ring 23. Spider ring 23 is optionally also made of a metal material, preferably aluminum, and the metal spider ring preferably is received in the spider plateau portion 46 of woofer basket 11. Basket 11 includes a circular valley having substantially straight sidewalls projecting transversely from the substantially planar plateau 46 to define a receptacle dimensioned to center and support the spider ring 23.

Basket 11 has distal outer or front flange 12 with the peripheral edge adapted to carry gasket ring 18 and has a proximal inner support surface or plateau spaced apart from the distal outer flange 12 by a distance (along the cone central axis) roughly equal to the front-to-back depth of cone 16. The basket spider valley is comprised of the planar plateau 46 and the perpendicular sidewall 45 projecting upwardly from the plateau 46. Together, basket valley sidewall 45 and basket plateau 46 define a receptacle which receives, centers and supports the spider ring 23. Spider suspension 22 preferably comprises a bulky layer treated fabric spider element permanently bonded with a glue joint to voice coil former 24 proximate the junction with cone 16 and bonded at its outer peripheral edge to spider ring 23 in a glue joint or the like. Referring now to FIG. 2, spider ring 23 is optionally an annular ring and spacer which attaches to two three-layer spiders, one-three layer spider is glued to the top of spider ring 23 and one three layer spider is spaced apart from the first and is glued to the bottom of ring 23. Spider ring 23 fits in and is centered on basket spider plateau 46. As best seen in FIG. 2, spider ring 23 has a selected proximal-to-distal (or lower to upper) thickness defined between a proximal (motor side) surface and a distal (cone side) surface and distal three layer annular spider 22*a* is connected to spider ring 23 adjacent the distal surface, while the proximal three layer annular spider 22*b* is connected to the spider ring 23 adjacent the proximal surface of spider ring 23, a distance roughly corresponding to the thickness of spider ring 23. As noted above, woofer 10 optionally includes 2 voice coils, one layered on top of the other on voice coil former 24 and each of the 2 voice coils is preferably of a standard (e.g. four ohm) impedance and is terminated in first and second voice coil lead terminals.

Thus, the typical prior art woofer has a well understood electro-dynamic motor assembly 14 using at least one voice coil to reciprocally drive at least one transducer diaphragm in a fore and aft or in and out pistonic motion which radiates sound directly into an ambient space. These typical direct radiating low frequency transducer designs have not really proven satisfactory for many audio system designers and audio enthusiasts.

Others have attempted to use rotary or rotating vane structures driven by rotating motor structures such as rotating commentator motors or rotating servomotors (i.e., rotor within stator motors) such as are disclosed in U.S. Pat. Nos. 4,564,727, 4,763,358 (Danley et al) or U.S. Pat. No. 5,825,901 (Hisey), but these low frequency transducer systems have, not found favor in the marketplace, possibly because of the complexity, cost and weight associated with motors having rotating armatures (e.g., rotors) within stators. There is a need, therefore, for a simpler and more compact transducer structure and a method for configuring and installing one or more transducers.

SUMMARY OF THE INVENTION

In accordance with the present invention, a compact, efficient and powerful low frequency audio transducer design overcomes the problems of the prior art by providing a novel structure for controlling and driving a plurality (e.g., four) gas impermeable diaphragm members or vanes rotating back and forth within a vented tubular chamber or lumen through a selected maximum excursion arc or excursion angle (e.g., 45 degrees), but not in a direct-radiating pistonic motion.

The bass pump transducer of the present invention uses at least one, and preferably two opposing linear reciprocating electrodynamic motor structures configured to drive a push-pull reciprocating gear or worm gear to rotate a shaft which in turn applies controlled rotation force to each vane.

In the preferred embodiment, a tubular housing defines a stationary support member which encloses a cylindrical chamber having a central axis, and the chamber is dimensioned to receive the moving components of the transducer assembly. The tubular housing member's chamber is a lumen having a first open end opposing a second open end.

In a first embodiment, a first linear reciprocating electrodynamic motor is mounted over the tubular housing member's first open end and is supported there by a substantially planar first spider-magnet mount. A second linear reciprocating electrodynamic motor is mounted over the tubular housing member's second open end and is supported there by a second substantially planar spider-magnet mount. Each of the linear reciprocating electrodynamic motors has a reciprocating voice coil which is readily energized to reciprocate the voice coil member to push or pull along the tubular housing member's central axis.

An elongate straight, rigid camshaft is affixed between said first motor's voice coil member and said second motor's voice coil member, which are wired out of phase, so that during a first excursion, said first motor's voice coil member is driven to push said first motor's voice coil member and said straight, rigid camshaft toward said second motor's voice coil member, which is simultaneously driven to pull said straight, rigid camshaft, in this manner, an alternating current signal fed to both linear reciprocating electrodynamic motor structures causes a reciprocating motion alternately pushing the straight, rigid camshaft away from said first motor's voice coil member and then pulling the straight, rigid camshaft into or toward the first motor's voice coil member.

The transducer's opposing linear reciprocating electrodynamic motors drive the straight, rigid camshaft which carries an external helical gear or worm gear which reciprocates linearly. The transducer vanes are carried on a supporting cam sleeve member having an interior sleeve lumen with inwardly projecting cam surfaces which engage the camshaft's external worm gear surfaces and, as the camshaft reciprocates linearly, it imparts a rotating reciprocal motion to the cam surfaces within the sleeve which in turn applies a controlled rotation force to each vane.

The transducer of the present invention produces substantial and powerful low frequency sound from a compact package. The structure and method of the present invention provides a rotary acoustic transducer for producing sound in response to an applied electrical signal, and comprises a tubular housing having a generally cylindrical chamber with an interior lumen defining a cylindrical sidewall terminating in a first open end which opposes a second open end. The tubular housing is generally symmetrical about a central axis. The transducer has a first linear reciprocating electrodynamic motor having a voice coil member, and the first motor is mounted over the tubular housing member's first open end using a spider magnet mount which orients the first motor's voice coil member inwardly, facing the lumen. A second linear reciprocating electrodynamic motor is mounted over the tubular housing member's second open end with a second spider mount and the second motor's voice coil member is oriented inwardly, facing the lumen and the first motor. An elongate rigid camshaft is affixed between the first motor's voice coil member and the second motor's voice coil member, and the camshaft carries a radially projecting helical worm gear surface.

A rotatable transducer cam and vane assembly includes an axially aligned cam sleeve having a central sleeve lumen with inwardly projecting cam surfaces configured to rotatably engage the camshaft's radially projecting helical worm gear surface. The cam and vane assembly has two or more rotating vanes projecting radially away from the central cam sleeve, so that the camshaft and the rotatable transducer vane assembly form a rotor assembly configured to rotatably fit within the chamber's interior lumen. The tubular housing has at least first and second inwardly stationary vanes mounted within said chamber with a stationary vane between each movable vane and extending between the cylindrical sidewall and the cam sleeve and axially between said end walls to define squeezable volumes of air trapped between moving and stationary vanes.

The tubular housing's cylindrical chamber has at least first and second ports opening through the walls of the cylindrical chamber to provide fluid communication and direct air flow into and out of the cylinder's squeezable volumes in response to movement of the movable vanes. In this way, the first and second linear reciprocating electrodynamic motors, being coupled to the camshaft are configured to simultaneously applying cooperating linear reciprocating movement to the camshaft so that the camshaft, when engaging the cam sleeve, provides rotational reciprocating movement to the rotor assembly, through a selected excursion arc which is controlled by the linear excursion of the first and second motor voice coil members.

The above and still further features and advantages of the present invention will become apparent upon consideration of the following detailed description of a specific embodiment thereof, particularly when taken in conjunction with the accompanying drawings, wherein like reference numerals in the various figures are utilized to designate like components.

BRIEF DESCRIPTION OF THE DRAWINGS

FIGS. 5A-50 are four views illustrating the configuration of an elongated camshaft member configured to engage and drive the reciprocally twisting diaphragm member as used within the compact low frequency transducer assembly of FIGS. 3A-4E, in accordance with the present invention.

FIGS. 11A and 11 B are two views illustrating the Spacer member which is configured align and support the Spider-Magnet mount member and axially align and support the opposing linear motors on opposing ends of the tubular housing of FIGS. 6A-6D as used within the compact low frequency transducer assembly of FIGS. 3A-4E, in accordance with the present invention.

FIG. 12 is an exploded perspective view in partial cross section Top Bushing a motor elements aligning and supporting the upper or top linear motors on the top end of the tubular housing of FIGS. 6A-6D as used within the compact low frequency transducer assembly of FIGS. 3A-4E, in accordance with the present invention.

FIG. 13 is an exploded side view, in elevation showing the coaxially aligned housing and motor elements aligning and supporting the opposing linear motors on the ends of the tubular housing of FIGS. 6A-6D as used within the compact low frequency transducer assembly of FIGS. 3A-4E, in accordance with the present invention.

FIG. 14 is an exploded side view, in elevation and partial cross section showing the coaxially aligned housing and motor elements aligning and supporting the opposing linear motors on the ends of the tubular housing of FIGS. 6A-6D as used within the compact low frequency transducer assembly of FIGS. 3A-13, in accordance with the present invention.

FIG. 15 is a perspective view in elevation illustrating a loudspeaker system including a cabinet or and enclosure assembly and including the transducer of FIGS. 3A-14, in accordance with the present invention.

FIG. 16 is a perspective view in partial cross section illustrating the loudspeaker system of FIG. 15 including a cabinet or and enclosure assembly configuration with the transducer of FIGS. 3A-14, in accordance with the present invention.

FIG. 17 illustrates a second "pin-drive" embodiment of the present invention and is a side view, in elevation and partial cross section showing the coaxially aligned housing and reciprocating diaphragm elements aligned and supported within the lumen of the tubular housing of FIGS. 6A-6D as used within another compact low frequency transducer assembly, in accordance with the present invention.

DESCRIPTION OF THE PREFERRED EMBODIMENT

Turning now to FIGS. 3A-14, the components and configuration of a first embodiment of a bass pump transducer 100 are illustrated, in accordance with the present invention. Compact bass pump transducer 100 uses at least one, and preferably two opposing linear reciprocating electrodynamic motor structures 102, 104 configured to drive a push-pull reciprocating gear or worm gear to rotate a shaft which in turn applies controlled rotation force to each vane.

Figure 1:
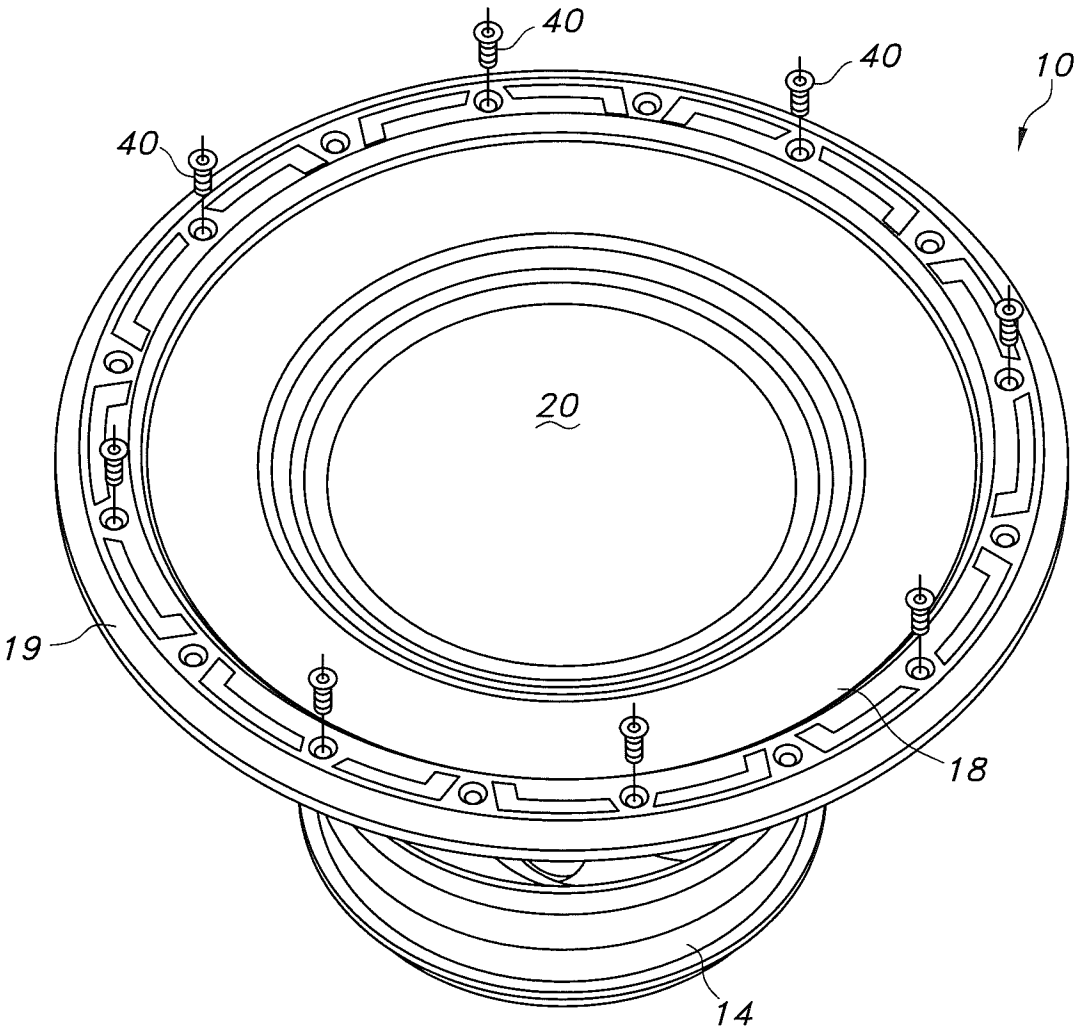
FIG. 1 (PRIOR ART)
FIG. 1 is a perspective view in elevation illustrating a typical prior art pistonic woofer or low frequency transducer structure, for purposes of establishing a reference nomenclature.
Figure 2:
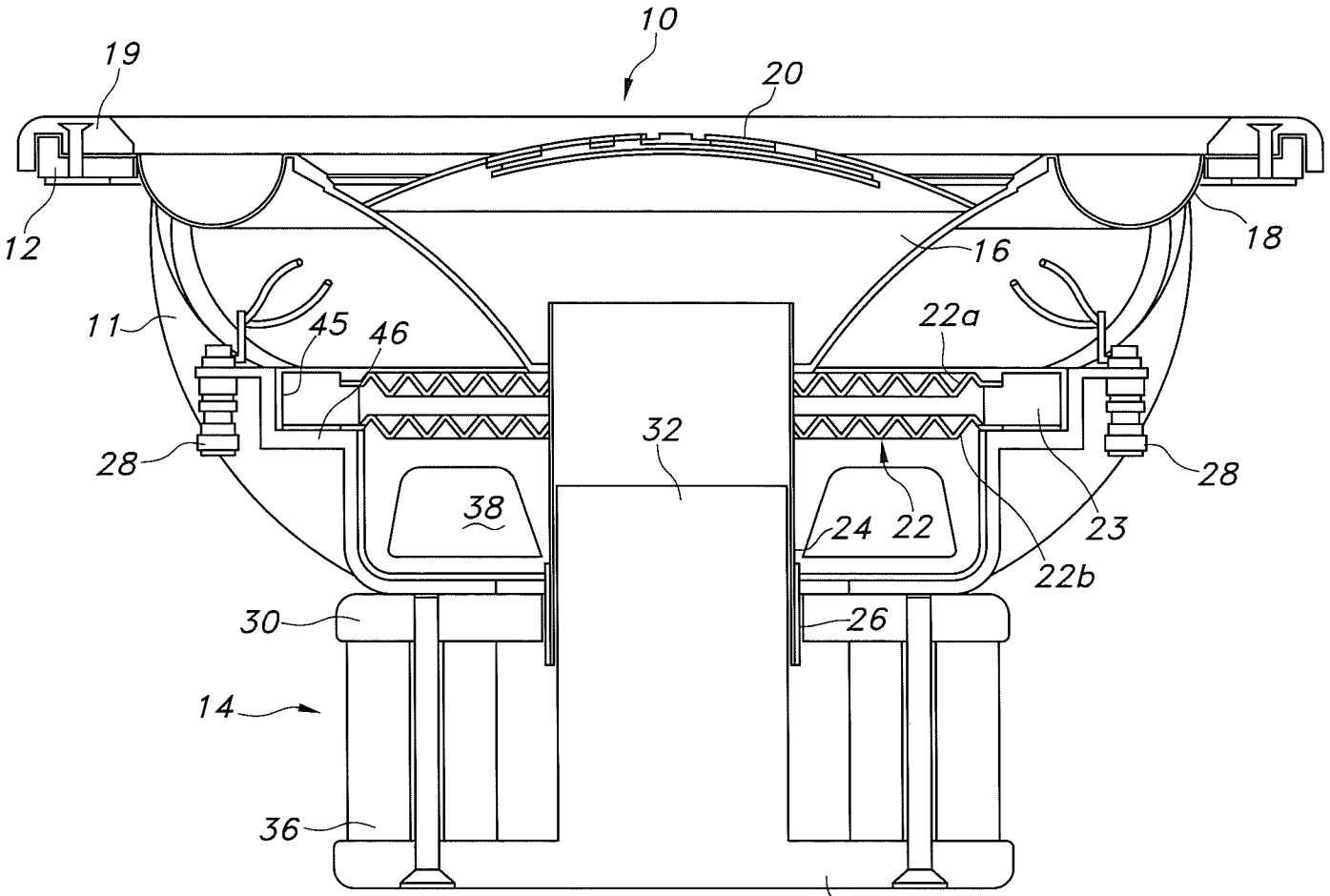
FIG. 2 (PRIOR ART)
FIG. 2 is a cross sectional view, in elevation illustrating the internal workings of the pistonic woofer or low frequency transducer of FIG. 1, for purposes of establishing a reference nomenclature.
Figure 3B:
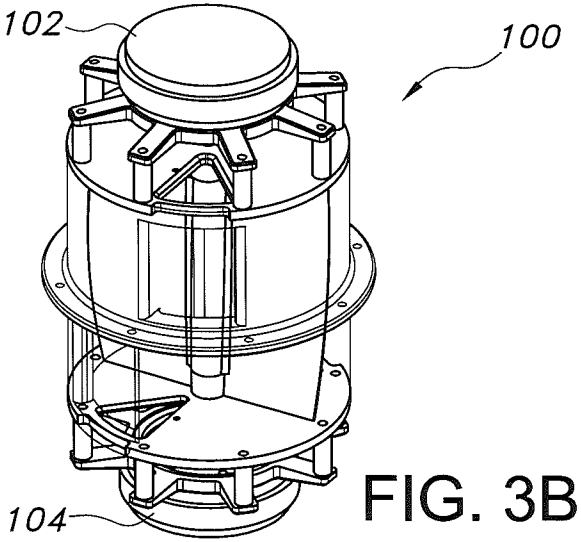
FIGS. 3A-3D are four views illustrating the configuration of a compact low frequency transducer assembly, in accordance with the present invention.
Figure 3D:
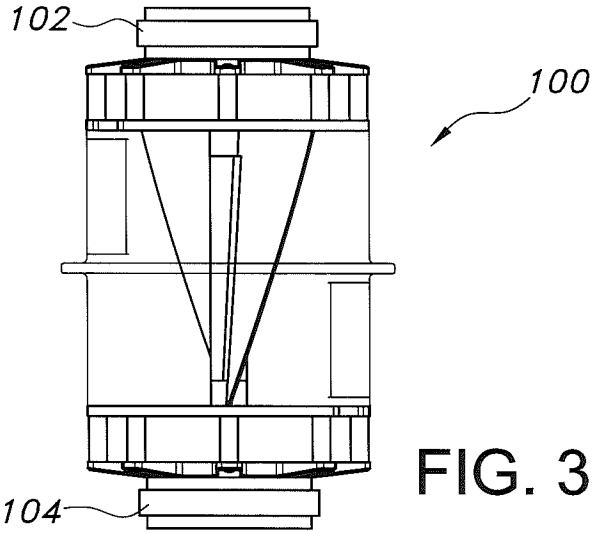
Figure 3A:
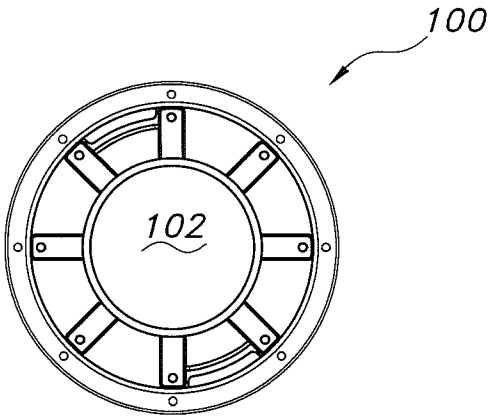
Figure 3C:
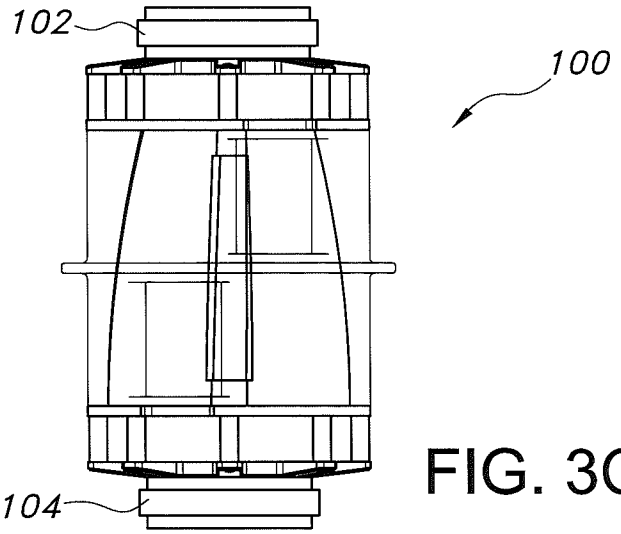
Figure 4B:
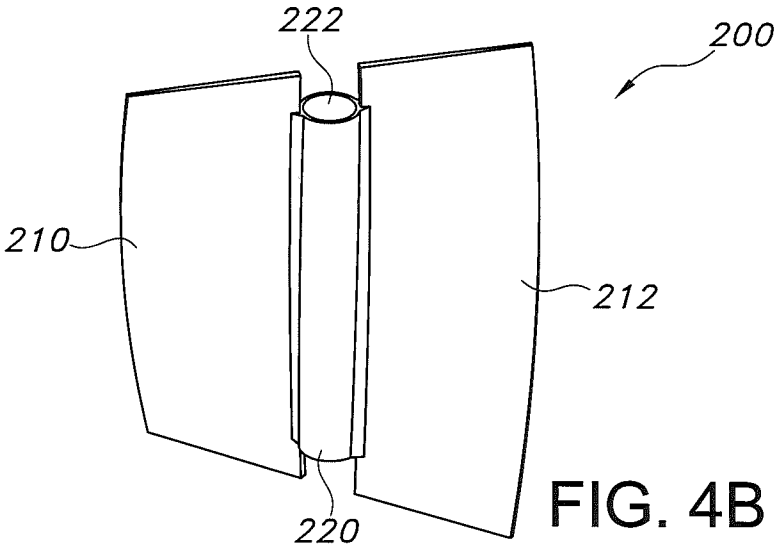
FIGS. 4A-4E are five views illustrating the configuration of a cam-driven reciprocally twisting diaphragm member as used within the compact low frequency transducer assembly of FIGS. 3A-3D, in accordance with the present invention.
Figure 4D:
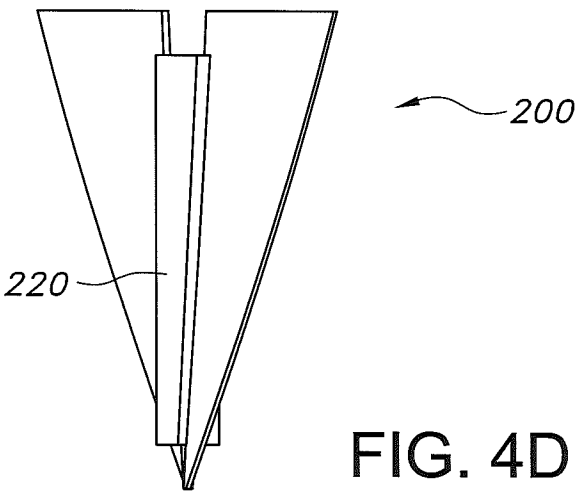
Figure 4A:
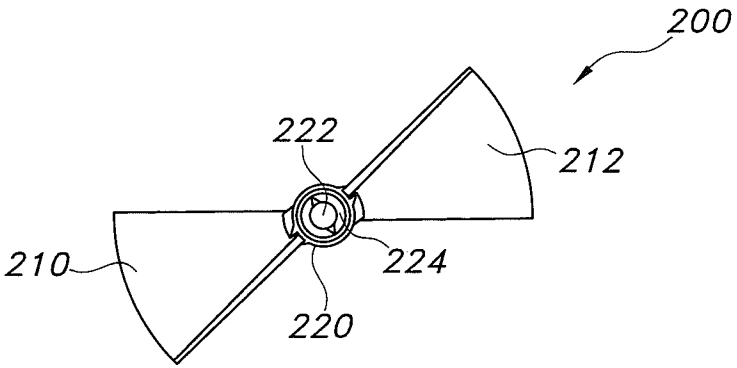
Figure 4C:
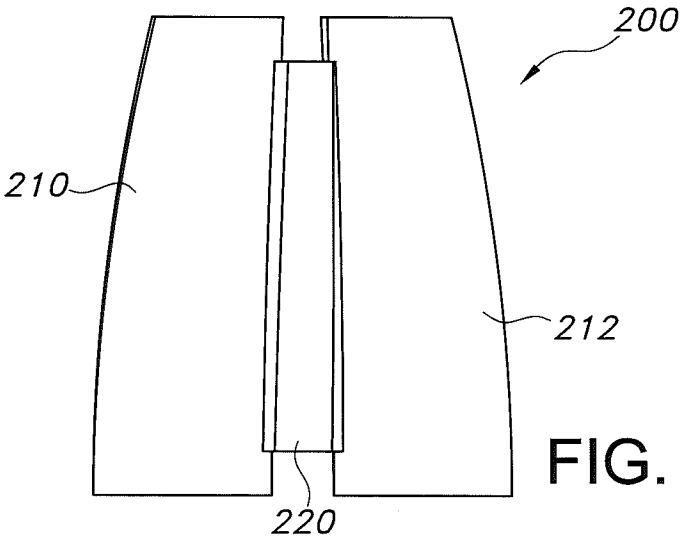
Figure 4E:
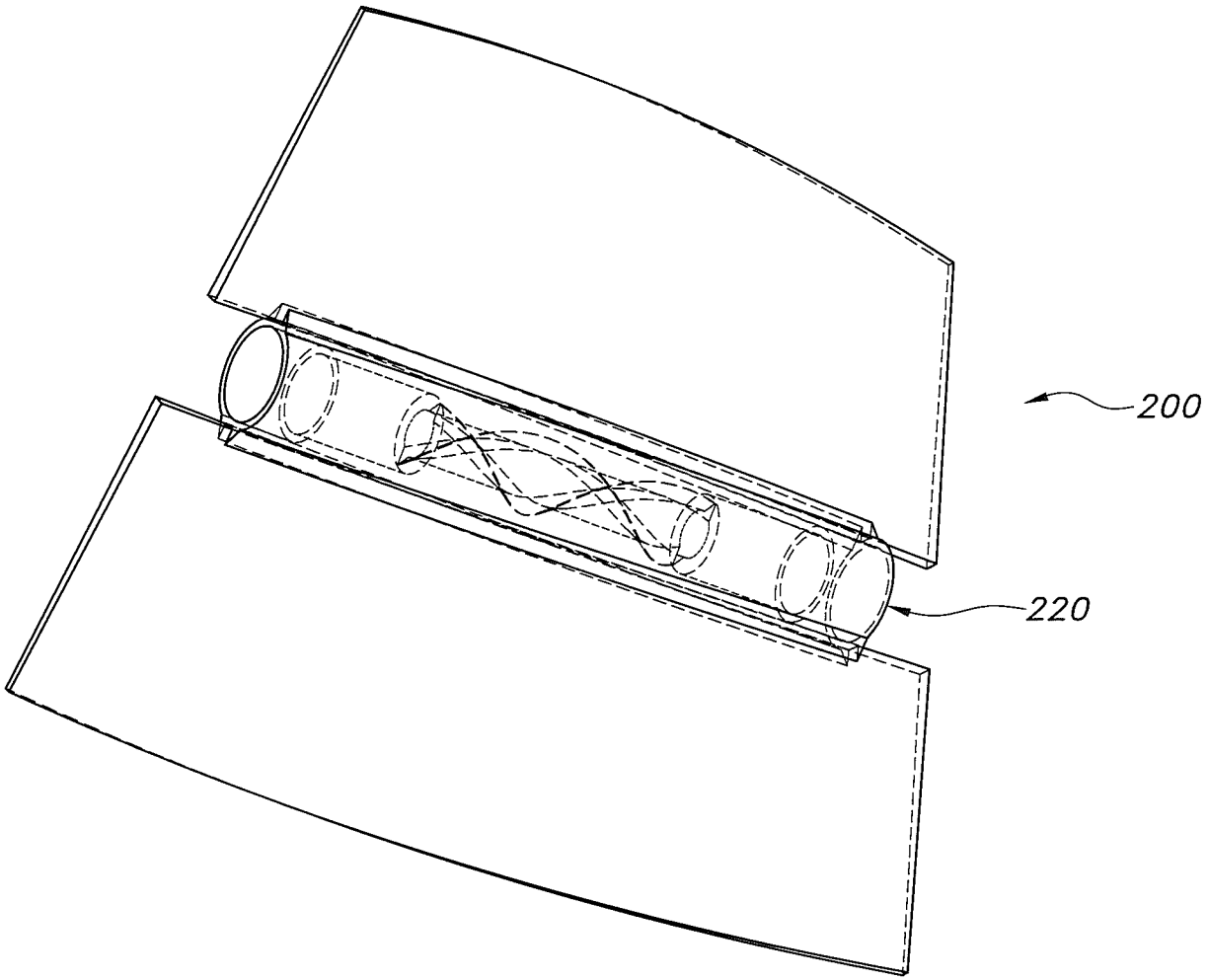
Figure 5B:
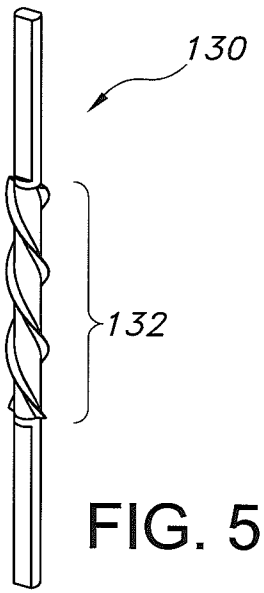
Figure 5D:
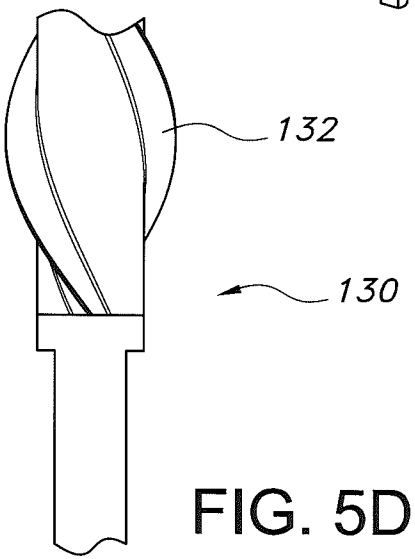
Figure 5A:
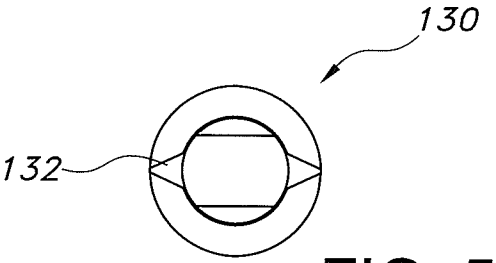
Figure 5C:
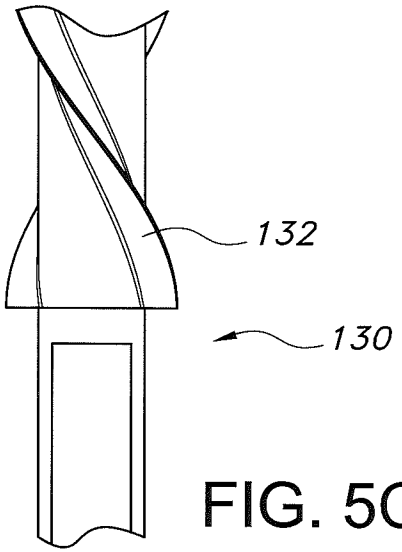
Figure 6B:
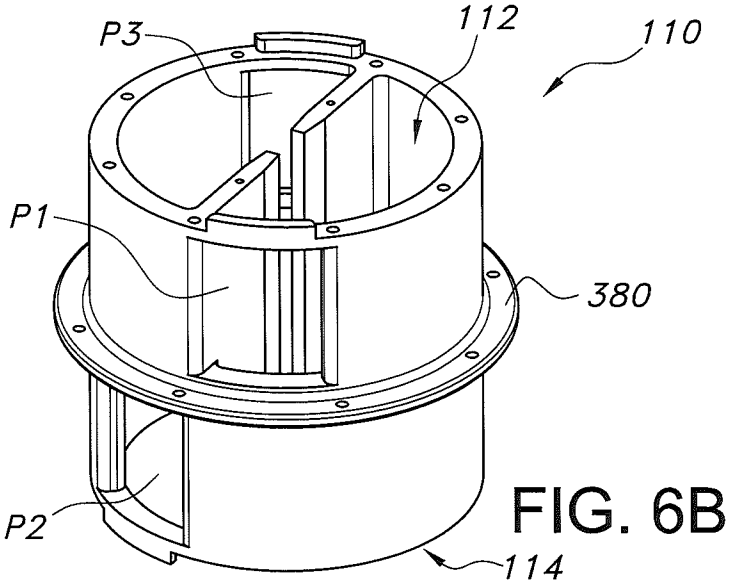
FIGS. 6A-6D are four views illustrating the flanged tubular housing configured to receive and support the reciprocally twisting diaphragm member as used within the compact low frequency transducer assembly of FIGS. 3A-4E, in accordance with the present invention.
Figure 6D:
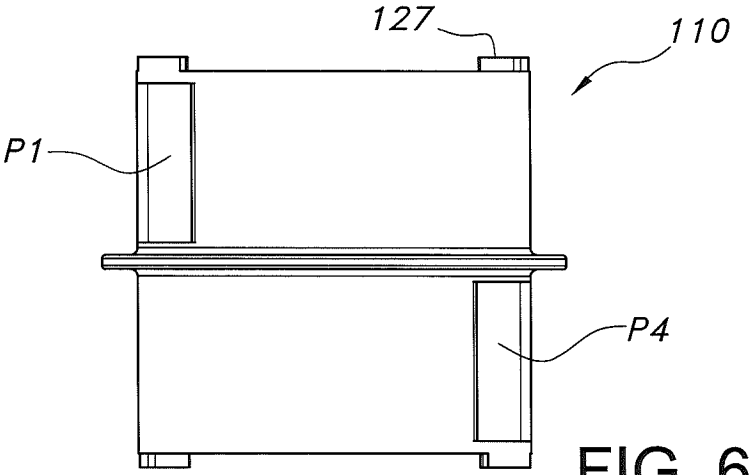
Figure 6A:
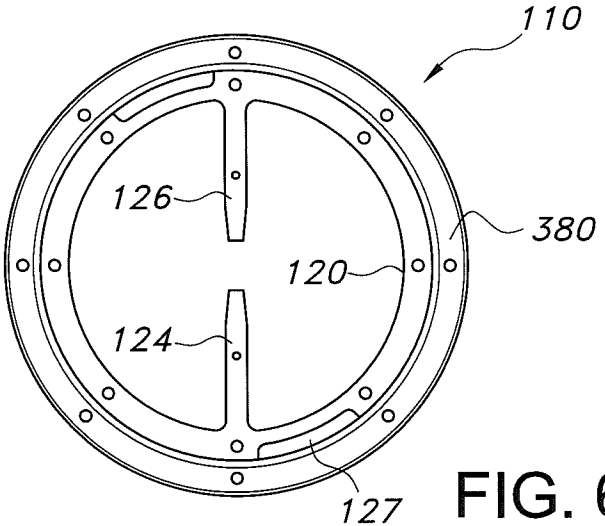
Figure 6C:
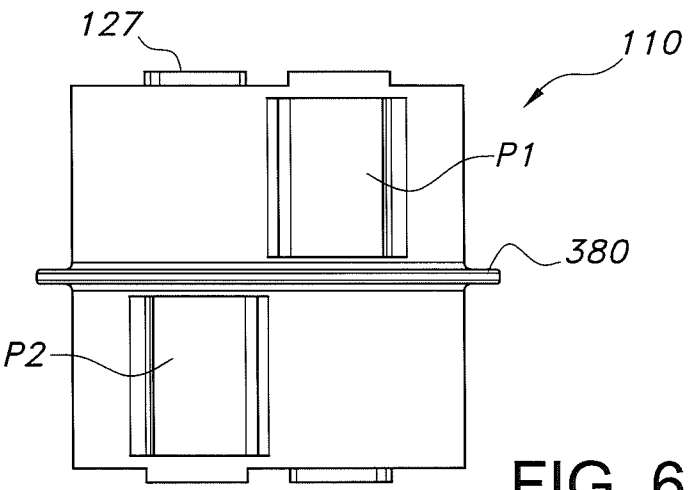
Figure 7A:
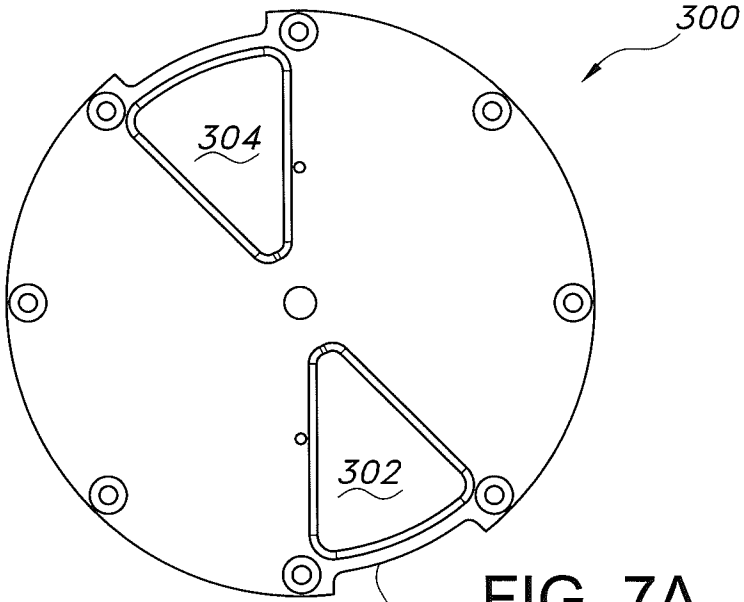
FIGS. 7A-7D are four views illustrating the Vent Plate member configured to be removably affixed to opposing open ends of the tubular housing of FIGS. 6A-6D to enclose and define vent openings for the chamber swept by the reciprocally twisting diaphragm member as used within the compact low frequency transducer assembly of FIGS. 3A-4E, in accordance with the present invention.
Figure 7B:
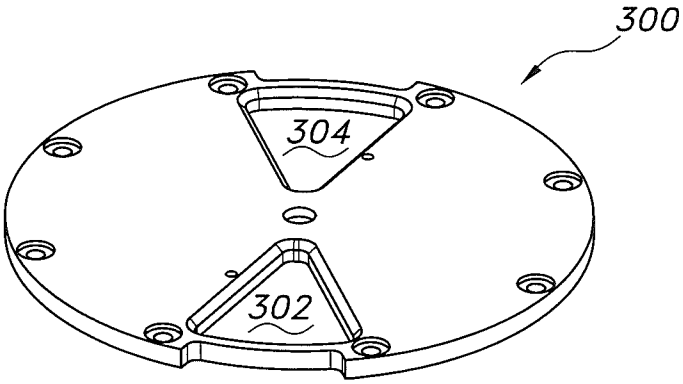
Figure 7C:
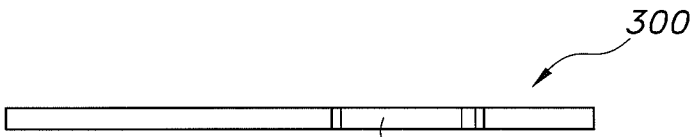
Figure 7D:
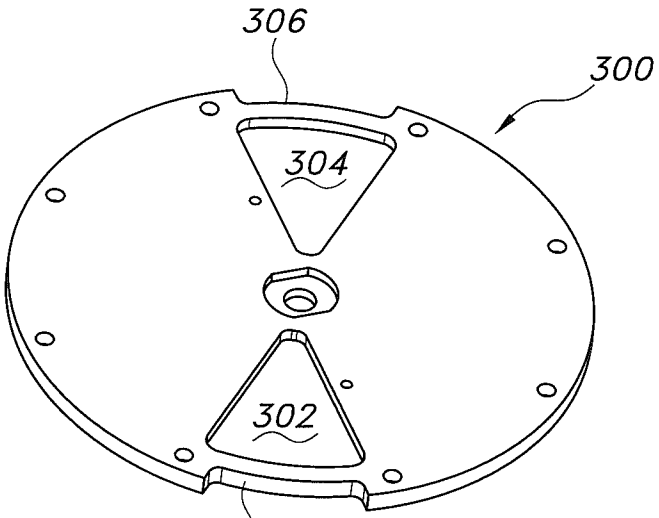
Figure 8B:
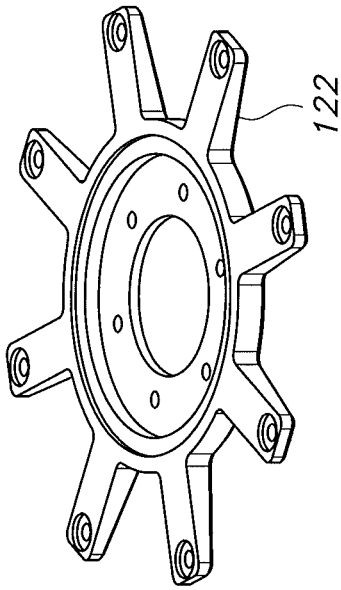
FIGS. 8A and 8B are two views illustrating the Spider-Magnet mount member configured axially align and support the opposing linear motors on opposing ends of the tubular housing of FIGS. 6A-6D as used within the compact low frequency transducer assembly of FIGS. 3A-4E, in accordance with the present invention.
Figure 8A:
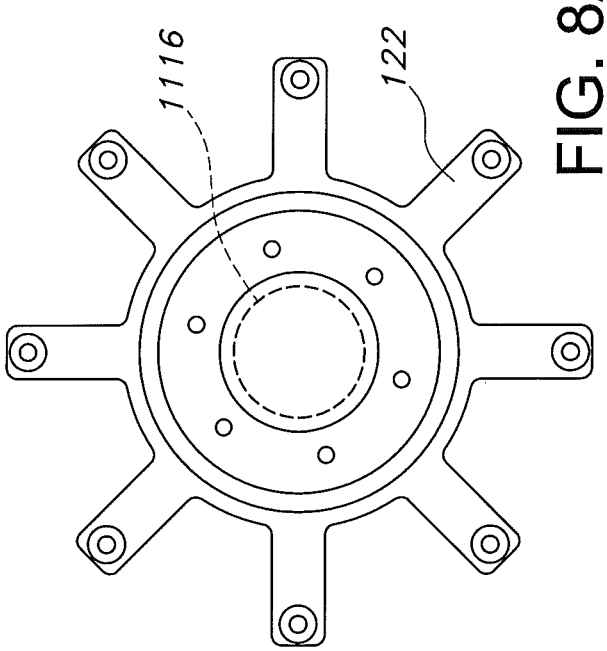
Figure 11:
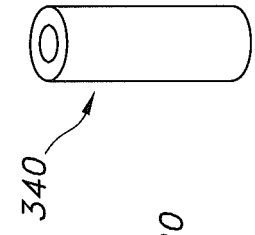
Figure 10B:
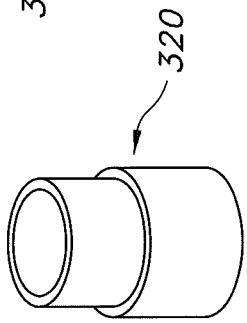
FIGS. 10A and 10B are two views illustrating the Outer bushing member configured nest coaxially with the inner bushing member to axially align and support the shaft driving the reciprocally twisting diaphragm member as used within the compact low frequency transducer assembly of FIGS. 3A-4E, in accordance with the present invention.
Figure 10A:
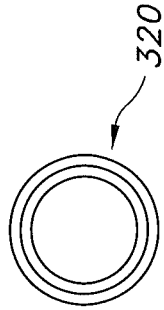
Figure 9B:
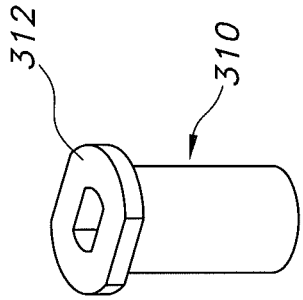
FIGS. 9A and 9B are two views illustrating the Inner Bushing member configured axially align and support the shaft driving the reciprocally twisting diaphragm member as used within the compact low frequency transducer assembly of FIGS. 3A-4E, in accordance with the present invention.
Figure 9A:
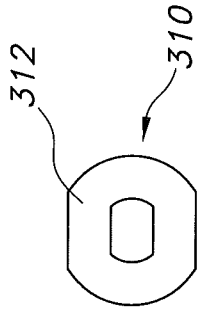

Electrodynamic motor structures 102, 104 resemble the standard woofer motor 14 illustrated in FIGS. 1 and 2, but are used to drive a very different kind of air displacement mechanism. Thus, electrodynamic motor structures 102, 104 may each include at least one electrically conductive voice coil 26 having two ends (plus and minus) is wound around voice coil former 24; the voice coil ends (plus and minus) are each electrically connected to a single terminal connector 28 by a releasable electrical connection. Optionally, first and second voice coils are wound on former 24, and each voice coil has its ends terminated in a single terminal connector 28, and so four terminal connectors 28 are mounted on basket 11. Each of the terminals is carried by and supported on a horizontal and planar flange incorporated into basket 11 and the connective portions of each of the terminal connectors are electrically insulated from the rigid basket material by the use of insulating spacers or terminal bases which align and support the basket terminal connectors 28. Electrodynamic motor structures 102, 104 may each include a magnetic circuit defined by a doughnut shaped or annular ring shaped planar front plate 30, which along with the pole piece 32 defines a magnetic gap to focus magnetic flux from magnet 36 across voice coil 26. A substantially planar and circular back plate 34 also provides part of the magnetic circuit, carries cylindrical pole piece 32 and provides structural support for magnet 36. An annular magnetic gap focusing the magnetic flux from magnet 36 is defined in the annular space between pole piece 32 and the circular opening in front plate 30. The annular gap has a radial extent sized to receive the voice coil former's thickness plus the voice coil's thickness to provide adequate clearance for the moving voice coil in the magnetic gap during operation. Each electrodynamic motor has, instead of a woofer cone, a reciprocating circular rigid coil cap member 116 mounted via a flexible suspension (e.g., like annular spider member 22*a*) configured to align and support one end of camshaft 130 and prevent twisting torque by a supporting the camshaft end.

Referring now to FIGS. 6A-6D, tubular housing 110 defines a stationary support member which encloses a cylindrical internal chamber having a solid sidewall terminating in a first circular open end 112 which is coaxially aligned with and opposite a second open end 114, and the internal chamber is dimensioned to receive the moving components of the transducer assembly. The tubular housing member's interior chamber is a lumen extending from first open end 112 to second open end 114 and the housing has four substantially rectangular vent ports, P1, P2, P3 and P4 which provide fluid communication between the housing's interior chamber and the exterior or ambient environment. The housing's exterior sidewall is preferably bisected by a circumferential flange 380 which projects transversely away from the central axis and the housing's sidewall, and ports P1 and P3 are defined in the sidewall above flange 380 while ports P2 and P4 are defined in the sidewall below flange 380. Housing 110 also has within the housing's interior lumen first and second inwardly projecting, substantially planar, axially aligned, fluid impermeable stationary vanes 124, 126, which effectively splitting the interior chamber's volume into first and second fixed sub-chambers, each vented by two ports. Referring again to FIGS. 6A-6D, ports P1 and P4 are defined in the sidewall which contain the right sub-chamber while ports P2 and P3 are defined in the sidewall which contain the left sub-chamber.

First linear reciprocating electrodynamic motor 102 is mounted over the tubular housing member's first open end 112 and is supported there by a substantially planar first spider-magnet mount 122. A second linear reciprocating electrodynamic motor 104 is mounted over the tubular housing member's second open end 114 and is supported there by a second substantially planar spider-magnet mount 122. Each of the linear reciprocating electrodynamic motors 102, 104 has a reciprocating voice coil which is readily energized to reciprocate the voice coil member to push or pull along the tubular housing member's central axis. Referring now to FIGS. 7A-7D, each housing open end is covered by a substantially planar, circular, fluid impermeable vent plate 300 having a central opening for the axially aligned camshaft and first and second pie-shaped ports 302, 304. Each vent plate port 302 304 is defined in the vent plate as a radially projecting opening symmetrically defines about a port radial central line, where each port defines an opening spanning a selected port opening angle (e.g., 50 degrees). Each vent plate also has first and second spaced circumferential wall indented segments 306 spaced to receive upwardly projecting housing tube sidewall tabs 127, and the indented segments 306 are preferably centered on the vent plate port radial central lines for first and second vent plate ports 302 304. Once installed, the vent plates serve to vent or provide fluid communication between a portion of the housing's interior chamber volume and the external or ambient environment. Referring again to FIGS. 15 and 16, upper vent plate port 302 is defined in the upper vent plate over the right sub-chamber upper vent plate port 304 is defined in the upper vent plate over the left sub-chamber.

An elongate straight, rigid camshaft 130 is affixed between said first motor's voice coil assembly (which carries a first coil cap member 116) and said second motor's voice coil assembly (which carries a second coil cap member 116), and the voice coils of the cooperating linear drivers are wired out of phase, so that during a first excursion, the first motor's voice coil member is driven to push the first motor's voice coil assembly and the camshaft 130 toward the second motor's voice coil assembly, which is simultaneously driven to pull camshaft 130. In this manner, an alternating current signal fed to both linear reciprocating electrodynamic motors 102, 104 causes a reciprocating motion alternately pushing straight, rigid camshaft 130 away from the first motor's voice coil rest position and then pulling the camshaft into or toward the first motor's voice coil rest position.

The transducer's opposing linear reciprocating electrodynamic motors 102, 104 drive the straight, rigid camshaft 130 which carries an external helical gear or worm gear 132 which reciprocates linearly. The transducer has a cam-vane assembly 200 with vanes 210, 212 carried on an axially aligned supporting cam sleeve member 220 having an interior sleeve lumen 222 with inwardly projecting cam surfaces 224 which engage the camshaft's external worm gear surfaces 132 and, as the camshaft 130 reciprocates linearly, it imparts a rotating reciprocal motion to the cam surfaces 224 within sleeve 220 which in turn applies a controlled rotation force to each vane 210, 212.

Figure 15:
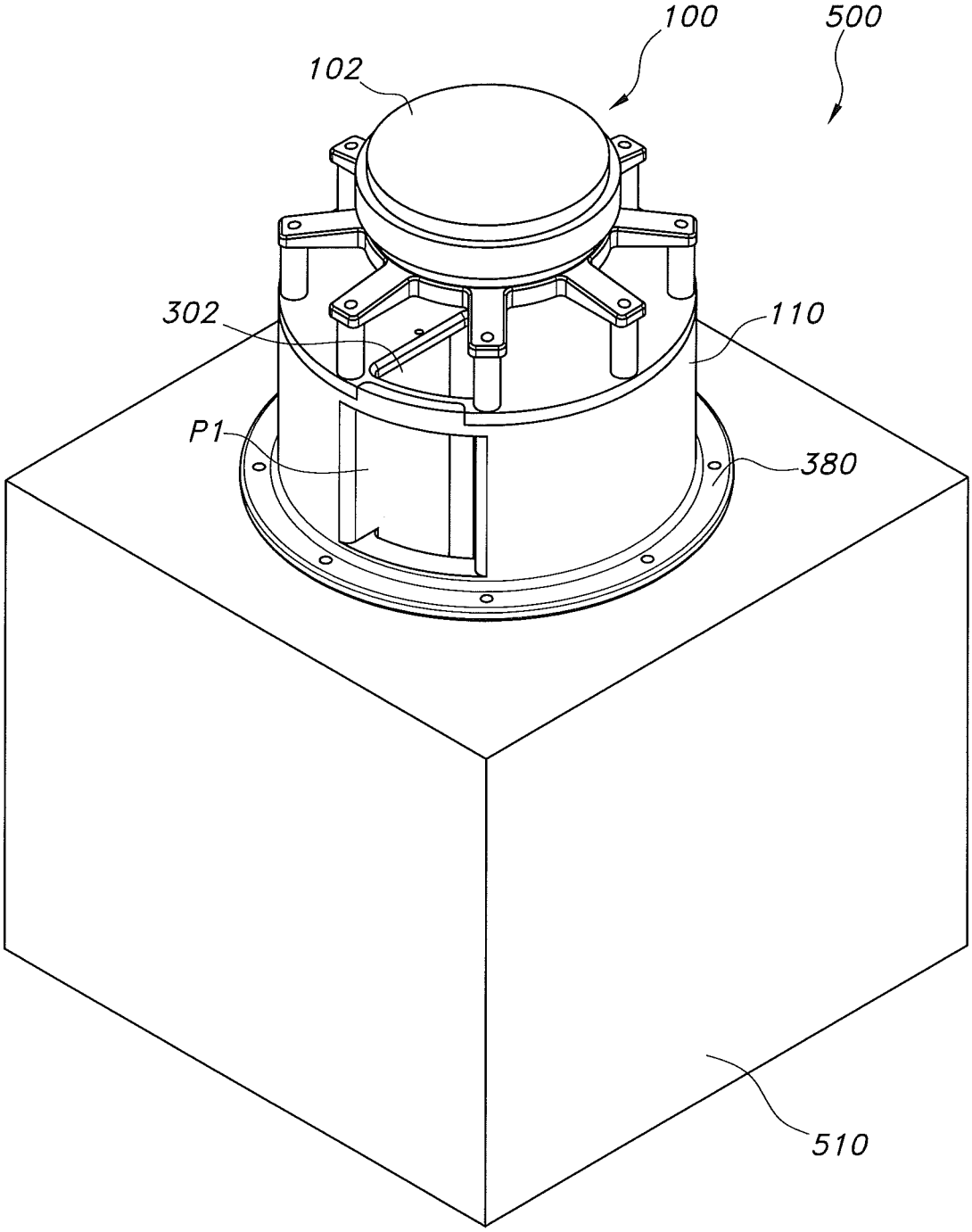
Figure 16:
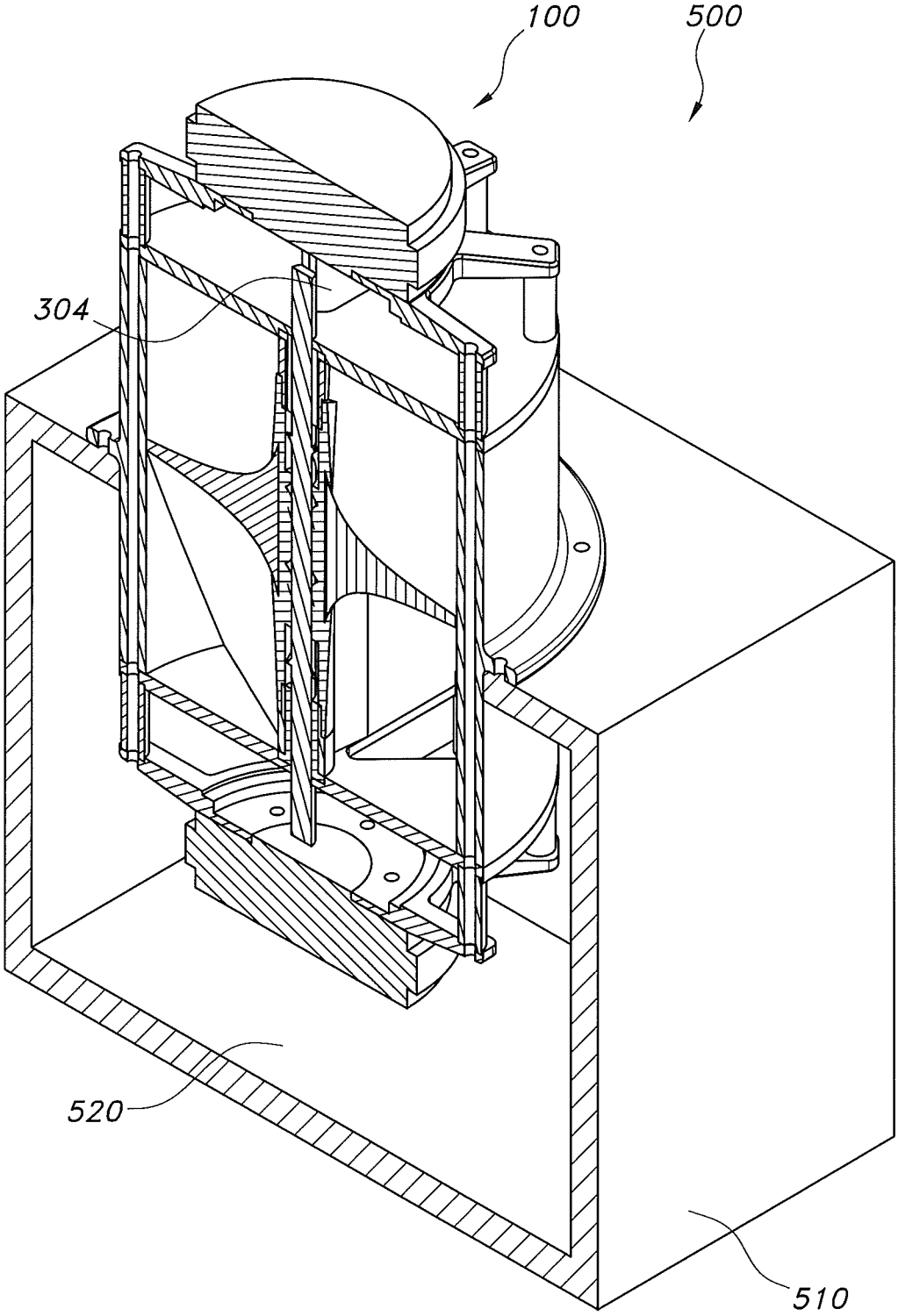

Transducer 100 provides a low frequency, 0-320+ Hz (Cycles per second) bass pump designed to reproduce subsonic frequencies and up through the first 4 audible octaves (possibly more) in the human hearing range. Transducer 100 is preferably mounted with one half (½) of housing 110 being within a sealed enclosure and affixed via the circumferential flange or center mounting 380 (As best seen in FIGS. 15 and 16). In principal, transducer 100 is made up of two primary moving parts. The first moving part is the camshaft 130 which is retained in the central lumen 222 of the cam-vane assembly 200. The cam-vane assembly 200 within the center of the tube housing is on bearings and divides the tube's interior lumen into two swept sub-volumes. Within the tube housing's interior lumen there are also the two stationary vanes 124, 126 splitting the tube into two sub-chambers giving the interior lumen a total of 4 chamber sub-volumes. The camshaft is slid through the center of the cam/vane assembly 200 and attached at both ends to conventional speaker motors 102, 104 via the caps. One speaker motor is connected reversed polarity to the other speaker motor to slide the camshaft in a push/pull motion back and forth through the center of the cam sleeve 220.

The compact transducer 100 of the present invention is configured in such a way that with every half of an inch (½ Inch) the camshaft slides along the central axis one way, cam sleeve 220 transfers force and energy to the transducer vane assembly and rotates the vane assembly in a first direction 45 degrees. So when the camshaft is at center and slides axially ½ inch, it transfers motion to the vane assembly and rotates or sweeps each vane from a center "0" position to a second position 45 degrees (e.g., counter clockwise). The reciprocating sequence for the transducer then moves the transducer vanes back to center and in response the camshaft slides or reciprocates back ½ inch, thus rotating the vane assembly in a second direction (opposite the first direction) 45 degrees, giving a total of 90 degrees of swept rotation for each side and a grand total of 180 degrees of total displacement, so the camshaft's total movement is 1 inch. As the cam rotates in a first (e.g., clockwise) direction, the two sub-chamber volumes in front of the moving vanes 210, 212 will define a combined volume of air that is squeezed or compressed while the two sub-chamber volumes behind the vanes movement will increase in volume, and momentarily reduce pressure. In combination with vents on both the vent plates 302, 304 and on the exterior walls of the tube (P1, P2, P3 & P4), transducer 100 compresses air into the sealed enclosure (e.g. 510, as illustrated in FIGS. 15 and 16), thus creating a rarefaction or moving vacuum region in the listening area as a reproduced sound wave. Then as the camshaft 130 reverses direction, the moving vane assembly 200 will create a vacuum inside the enclosure and a moving pressure region in the listening area. At frequencies of 20 to 360+ Hz, this is within human hearing range. Traditionally, 19 Hz and below would be considered subsonic.

The structure and driving method of the present invention provides a much more efficient way of reproducing low frequencies compared to the conventional loudspeaker driver of FIGS. 1 and 2. Direct radiator woofer 10 is limited in volume displacement related to how far the cone diaphragm 16 can travel up and down. Cam-driven rotary bass pump transducer 100 displaces much larger air volumes than conventional speakers from a single unit. This will greatly increase low frequency output while minimizing space and power used.

More specifically, the structure and method of the present invention provides a rotary acoustic transducer 100 for producing sound in response to an applied electrical (e.g., amplified music) signal, and comprises tubular housing 110 having a generally cylindrical chamber with an interior lumen defining a cylindrical sidewall 120 terminating in first open end 112 which opposes second open end 114. Tubular housing 110 is generally symmetrical about a central axis, Transducer 100 has a first linear reciprocating electrodynamic motor 102 having a voice coil member, and first motor 102 is mounted over the tubular housing member's first open end 112 using a spider magnet mount 122 which orients the first motor's voice coil member inwardly, facing the lumen. Second linear reciprocating electrodynamic motor 104 is mounted over the tubular housing member's second open end 114 with a second spider mount 122 and the second motor's voice coil member is oriented inwardly, facing the lumen and first motor 102. Elongate rigid camshaft 130 is affixed between the first motor's voice coil member and the second motor's voice coil member, and camshaft 130 carries a radially projecting helical worm gear surface 132.

The moving portion of the transducer includes rotatable transducer cam and vane assembly 200 which has an axially aligned cam sleeve 220 having a central sleeve lumen 222 with inwardly projecting cam surfaces 224 configured to rotatably engage the radially projecting helical worm gear surface 132 of camshaft 130. The cam and vane assembly 200 has two or more rotating vanes 210, 212 projecting radially away from the central cam sleeve 220, so that the camshaft 130 and the rotatable transducer vane assembly 200 form a rotor assembly configured to rotatably fit within the chamber's interior lumen 112. Tubular housing 110 has at least first and second inwardly stationary vanes 124, 126 mounted within the chamber and the transducer is assembled with a stationary vane between each movable vane and extending between the cylindrical sidewall 120 and slidably touching the cam sleeve 220 and axially between the lumen ends 112, 114 to define squeezable volumes of air trapped between moving and stationary vanes, The tubular housing carries first and second substantially circular vent plates 300 mounted proximate the cylindrical chamber's opposing open ends 112, 114 and the chamber has at least first and second ports (302, 304) opening through the vent plates 300 or the walls of the cylindrical chamber to provide fluid communication and direct air flow into and out of the cylinder's squeezable volumes in response to movement of the movable vanes 210, 212. In this way, the first and second linear reciprocating electrodynamic motors 102, 104, being coupled to the camshaft 130 are configured to simultaneously apply cooperating push-pull linear reciprocating movement to camshaft 130 so that the camshaft, when engaging the cam sleeve 220, provides rotational reciprocating movement to the rotor assembly, through a selected excursion arc (e.g., 45 degrees) where the magnitude of the excursion arc or angle is controlled by the linear excursion of the first and second motor voice coil members. The swept angle of the vent plate ports 302, 304 is preferably about equal to the vane assembly's excursion arc.

Figure 12:
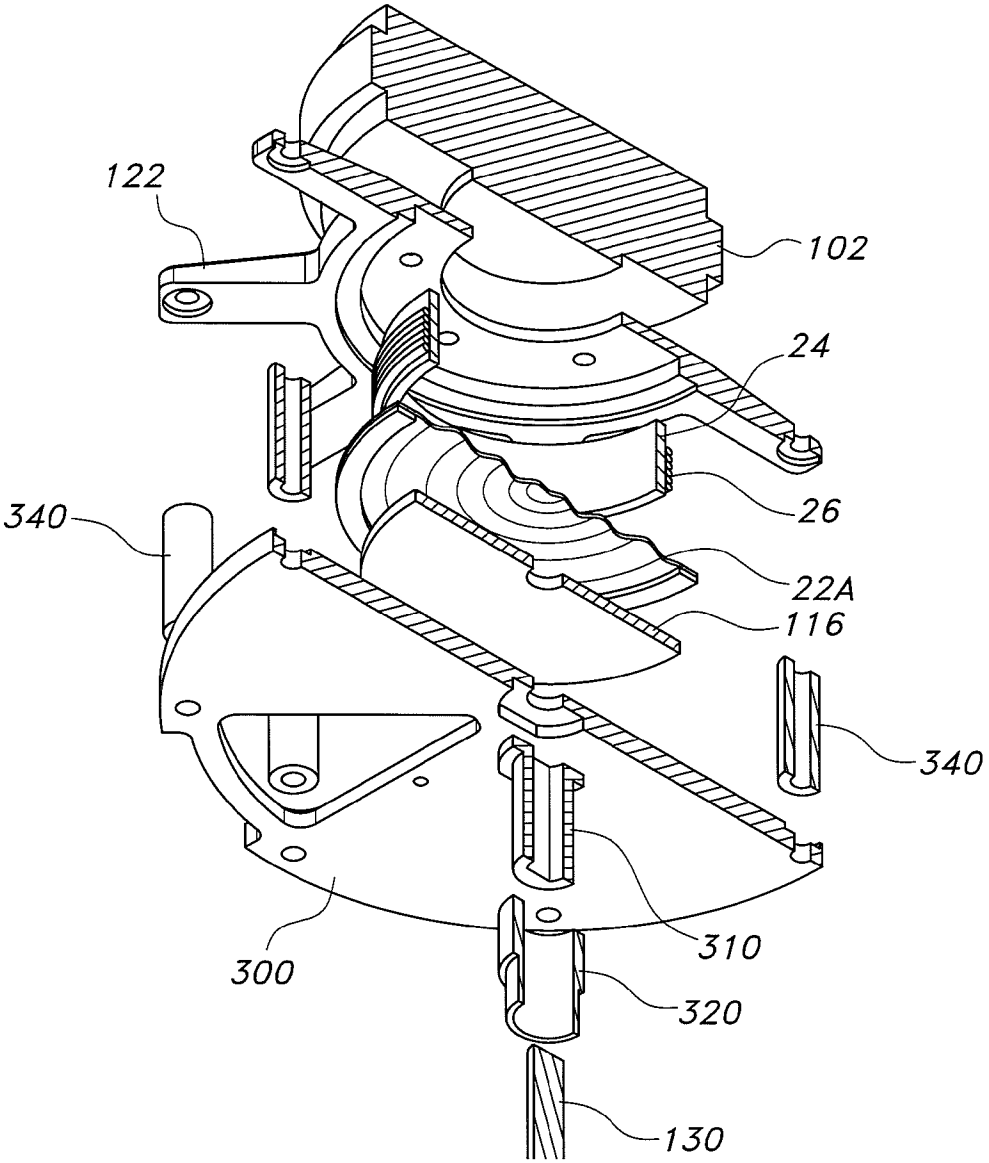
Figure 13:
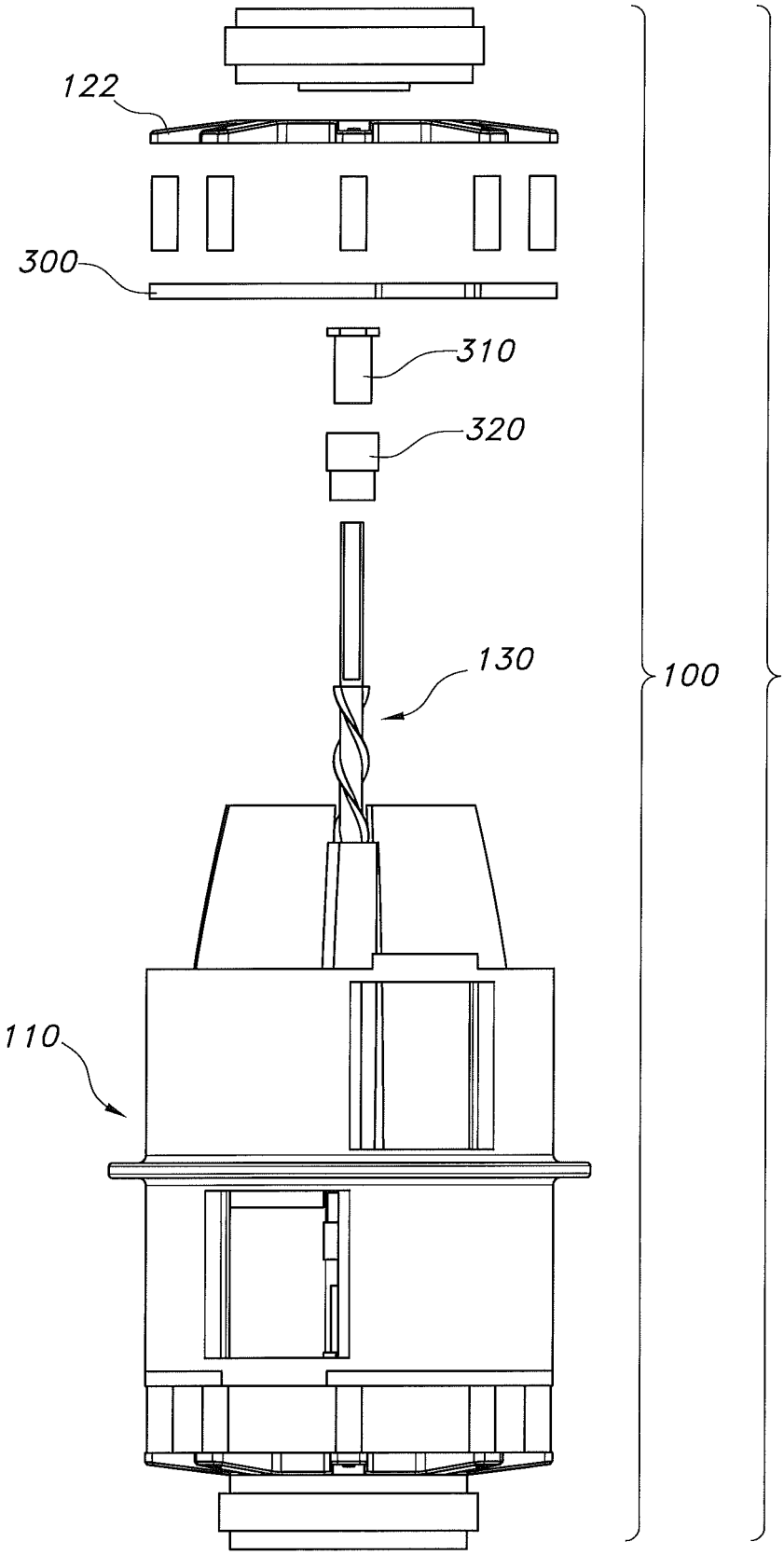
Figure 14:
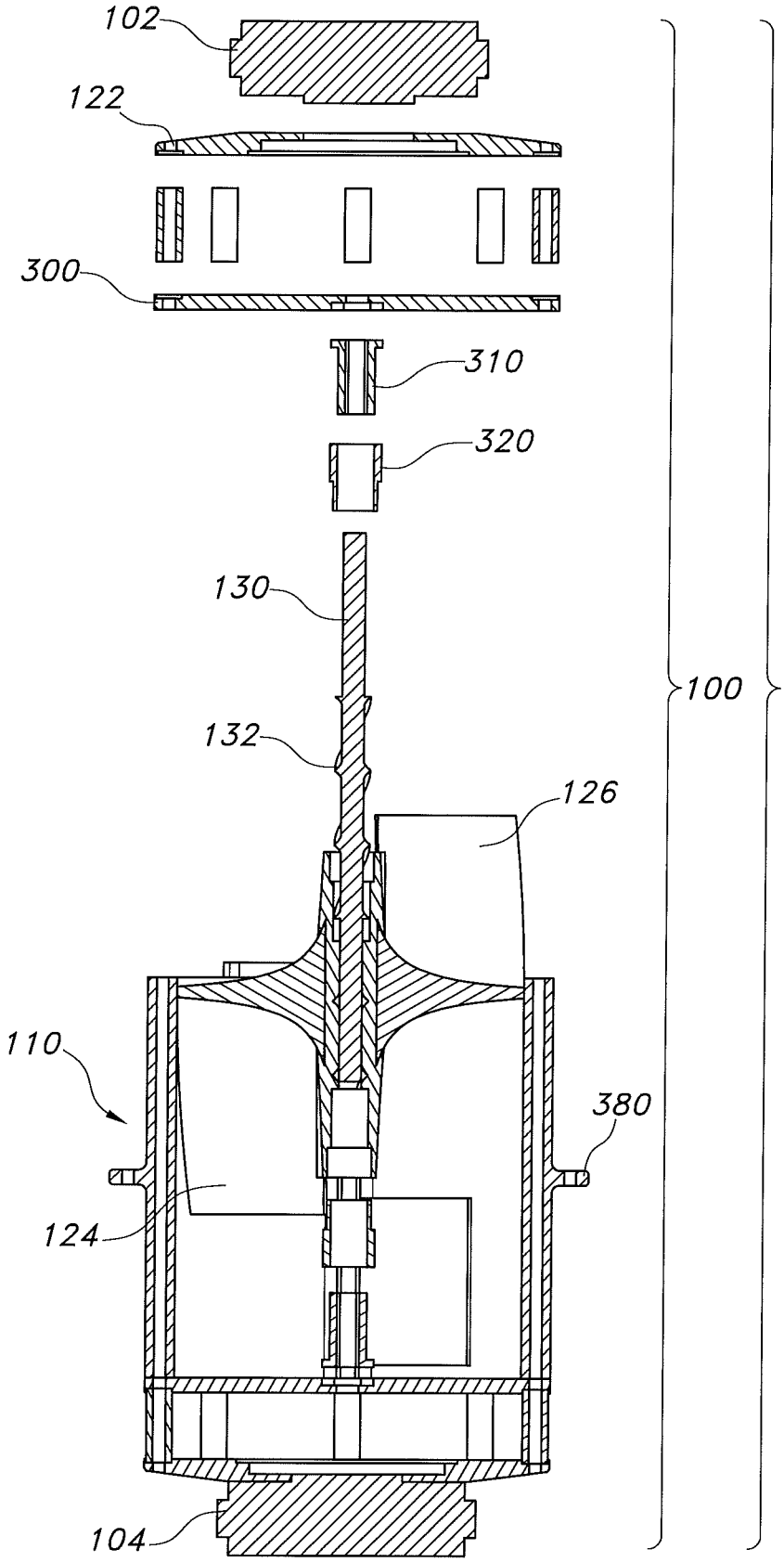

Referring now to FIGS. 9A-13, the alignment and support components of transducer 100 are illustrated. Tubular bushing 310 has a flanged proximal end 312 and a distal end connected by an open lumen configured to slidably receive, align and support camshaft 130, and fits coaxially within a tubular outer bushing 320, as best seen in FIGS. 12-14. Each motor supporting mount 122 is spaced from it's opposing vent plate 300 by a plurality (e.g., eight) tubular spacers 340 which also surround and protect threaded fasters (e.g., screws or bolts) which draw mount 122 into rigid engagement with vent plate 300.

FIGS. 15 and 16 illustrate a loudspeaker and enclosure assembly 500 with a box-shaped enclosure 510 configured to support transducer 100 at outer flange 380 and provide a selected tuned enclosure volume 520 for damping transducer 100, in accordance with the present invention. The illustrated embodiment is shown as a substantially sealed enclosure to provide "acoustic suspension" tuning, but the transducer of the present invention is also readily configured for use with and mountable within, ported, vented or resonant enclosures.

Figure 17:
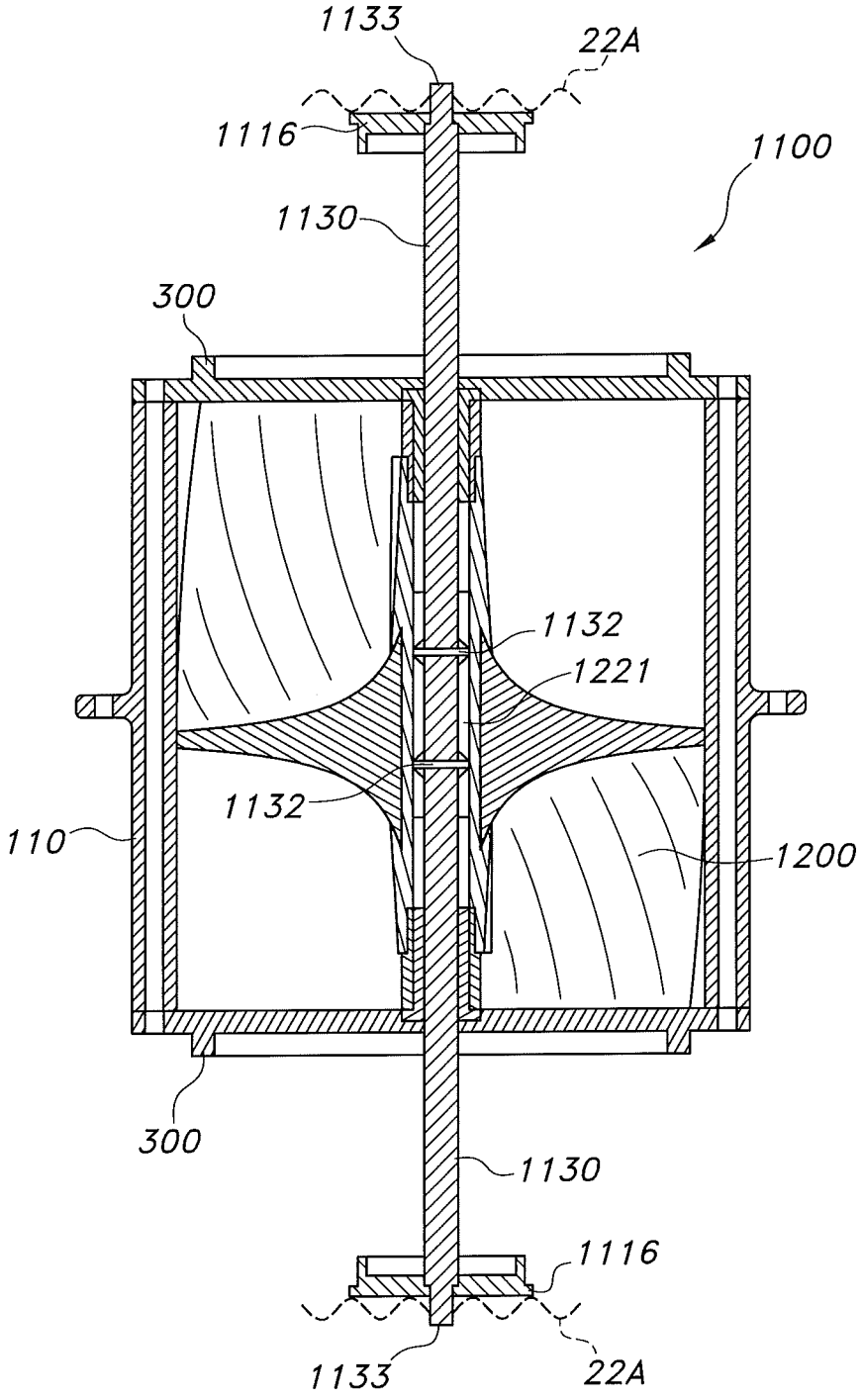
Figure 18B:
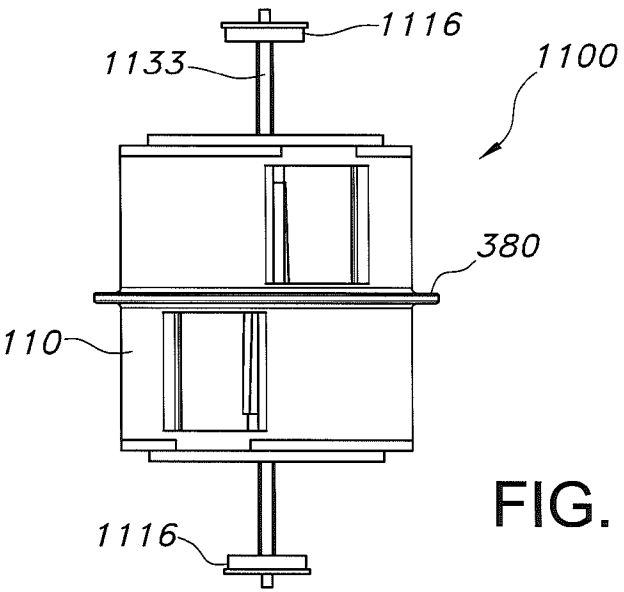
FIGS. 18A-18D are four views illustrating parts of the transducer assembly of FIG. 17 with coaxially aligned housing and reciprocating diaphragm elements aligned and supported within the lumen of the tubular housing of FIGS. 6A-6D as used within the pin-drive compact low frequency transducer assembly, in accordance with the present invention.
Figure 18D:
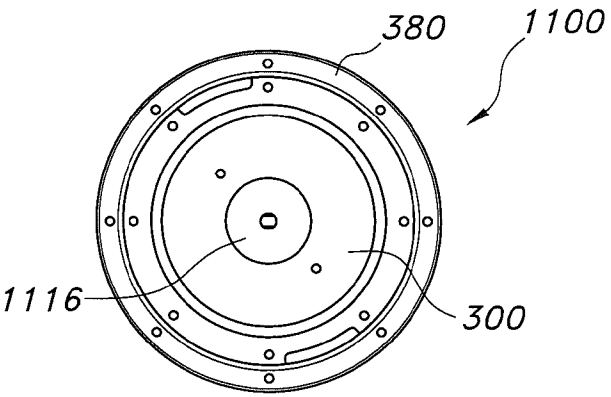
Figure 18A:
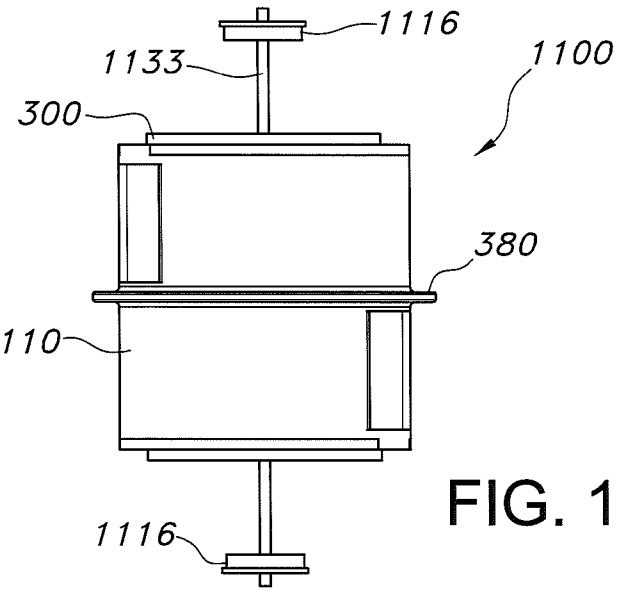
Figure 18C:
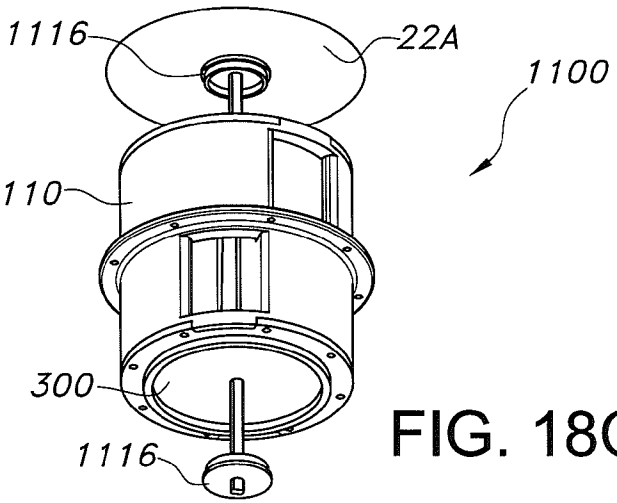
Figure 19B:
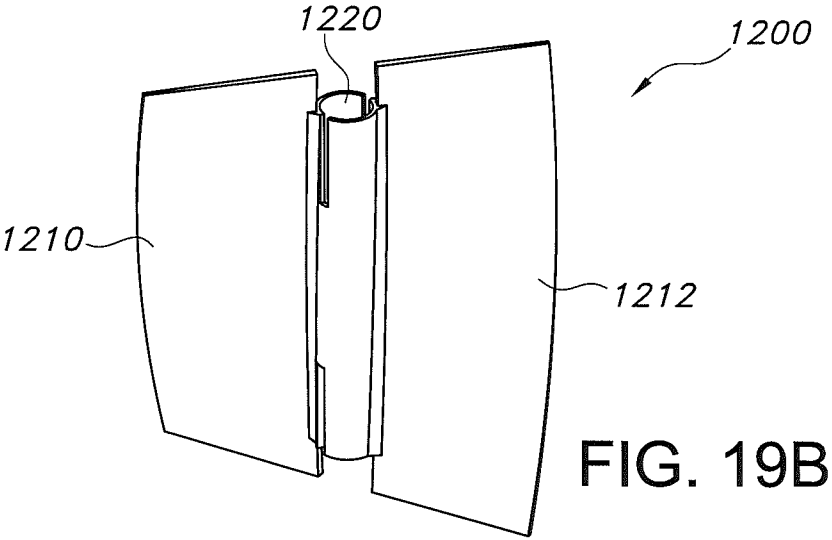
FIGS. 19A-19D are four views illustrating the configuration of the pin-drive reciprocally twisting diaphragm member as used within the compact low frequency transducer assembly of FIGS. 17-18D, in accordance with the present invention.
Figure 19D:
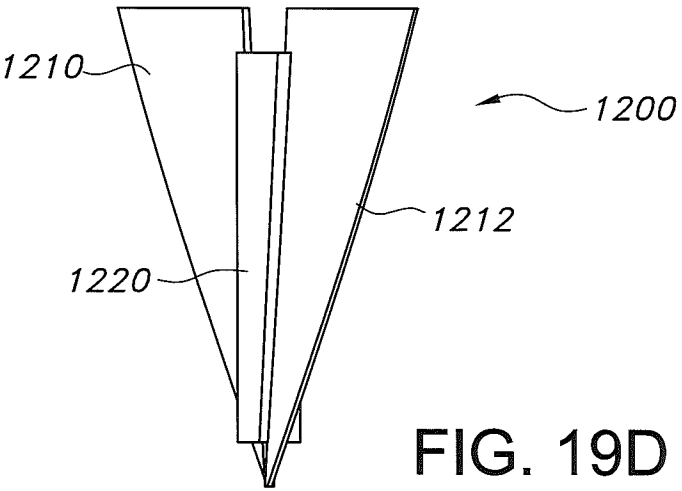
Figure 19A:
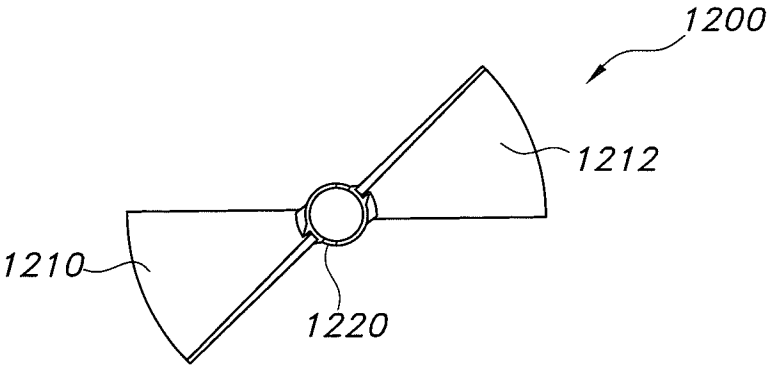
Figure 19C:
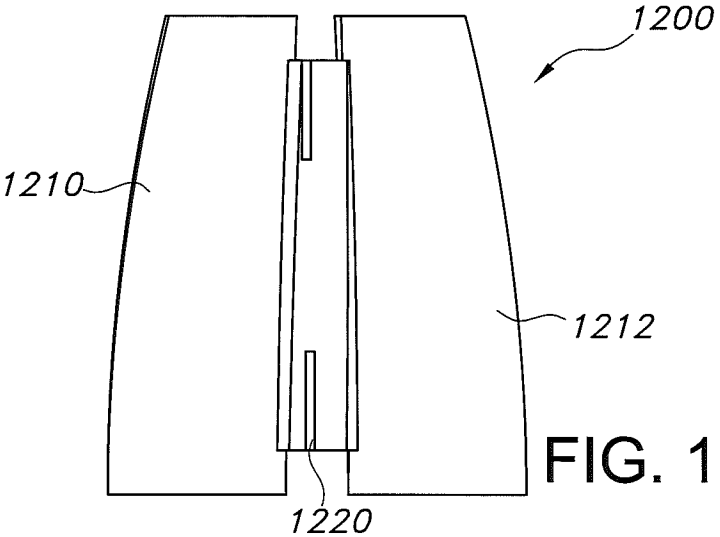
Figure 20D:
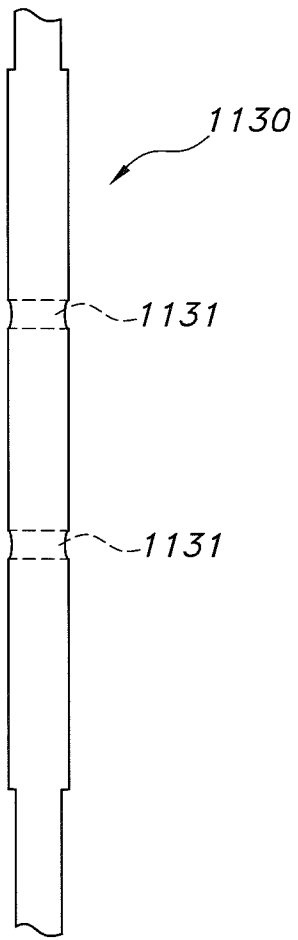
FIGS. 20A-20D are four views illustrating the configuration of an elongated drive shaft member configured with transverse force transmitting pin members to engage and drive the reciprocally twisting diaphragm member as used within the compact low frequency transducer assembly of FIGS. 17-19D, in accordance with the present invention.
Figure 20C:
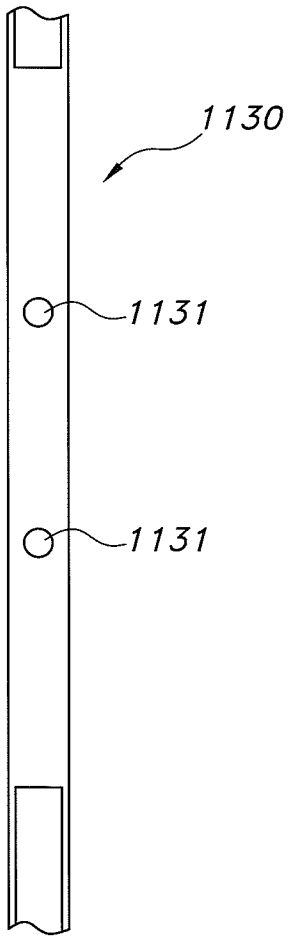
Figure 20B:
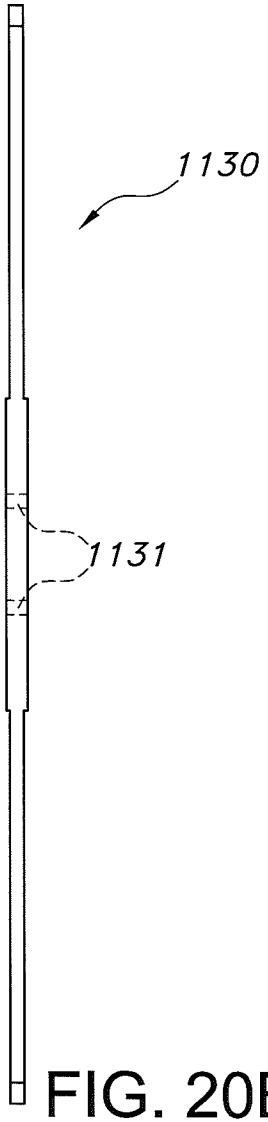
Figure 20A:
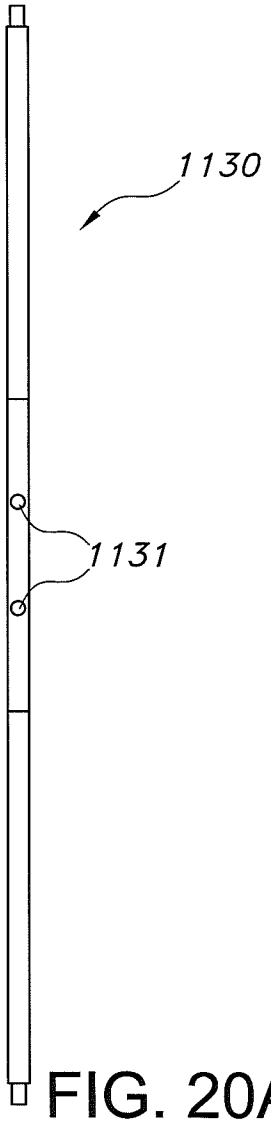
Figure 21B:
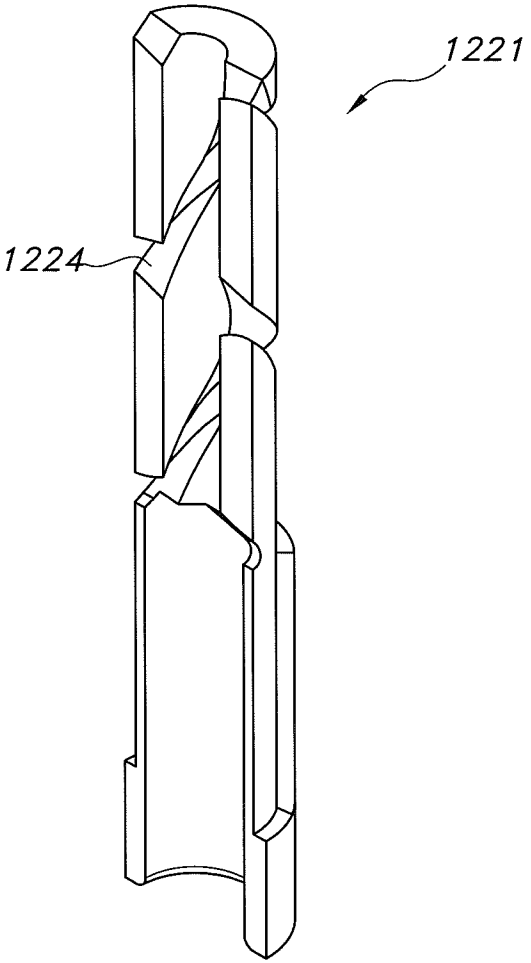
FIGS. 21A and 21B are elevation and perspective cross sectional views illustrating the configuration of tubular worm drive member dimensioned to slidably engage the transverse pins carried by the elongated drive shaft member and drive the reciprocally twisting diaphragm member of FIGS. 19A-19D, as used within the compact low frequency transducer assembly of FIGS. 17-20D, in accordance with the present invention.
Figure 21A:
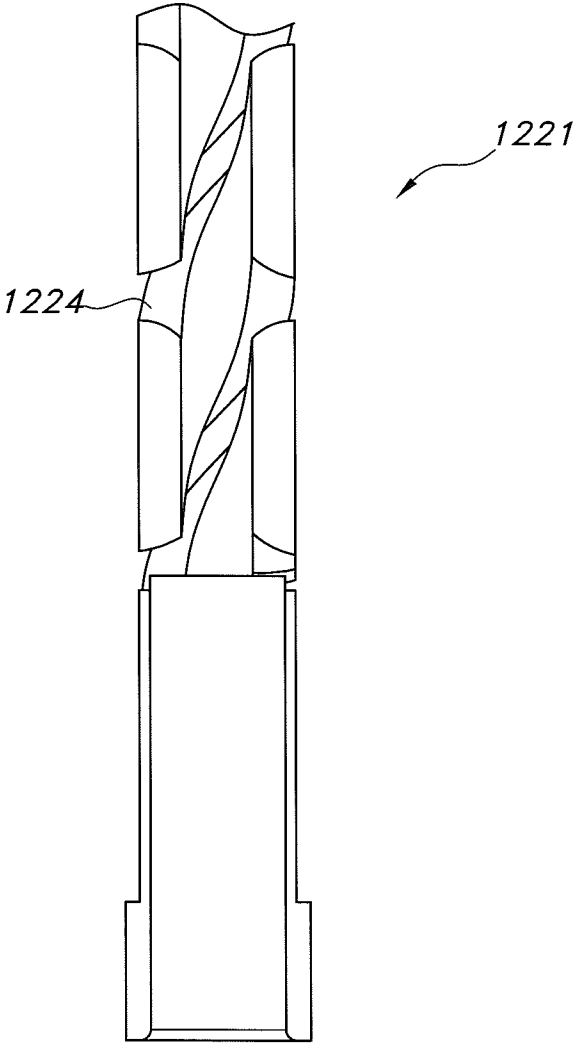

Turning now to FIGS. 17-21 B, the components and configuration of a second "pin-drive" embodiment of a bass pump transducer 1100 are illustrated. FIG. 17 illustrates the "pin-drive" embodiment of the transducer present invention 1100 and is a side view, in elevation and partial cross section showing the coaxially aligned housing 110 and reciprocating diaphragm elements aligned and supported within the lumen of the tubular housing 110 of FIGS. 6A-6D as used within this compact low frequency transducer assembly. FIGS. 18A-18D are four views illustrating parts of the transducer assembly of FIG. 17 with the coaxially aligned housing and reciprocating diaphragm 1200 aligned and supported within the lumen of the tubular housing 110. FIGS. 19A-19D are four views illustrating the configuration of the pin-drive reciprocally twisting diaphragm member 1200, as described below. FIGS. 20A-20D are four views illustrating the configuration of an elongated drive shaft member 1130 configured with transverse force transmitting pin members to engage and drive the reciprocally twisting diaphragm 1200. And FIGS. 21A and 21B are elevation and perspective cross sectional views illustrating the configuration of tubular worm drive member 1221 which is rigidly affixed within the interior lumen 1222 of sleeve member 1220 and dimensioned to slidably engage the transverse force transmitting pins 1132 carried by the elongated drive shaft member 1130 and drive the reciprocally twisting diaphragm member 1200.

Compact bass pump transducer 1100 shares many operating principles and components with the first embodiment's transducer, 100, as described above and uses at least one, and preferably two opposing linear reciprocating electrodynamic motor structures 102, 104 configured to drive a push-pull reciprocating gear or worm gear to rotate a shaft which in turn applies controlled rotation force to each vane.

As above, electrodynamic motor structures 102, 104 may resemble the standard woofer motor 14 illustrated in FIGS. 1 and 2, but are used to drive a very different kind of air displacement mechanism. Thus, electrodynamic motor structures 102, 104 may each include at least one electrically conductive voice coil 26 having two ends (plus and minus) is wound around voice coil former 24; the voice coil ends (plus and minus) are each electrically connected to a single terminal connector 28 by a releasable electrical connection. Optionally, first and second voice coils are wound on former 24, and each voice coil has its ends terminated in a single terminal connector 28, and so four terminal connectors 28 are mounted on basket 11. Each of the terminals is carried by and supported on a horizontal and planar flange incorporated into basket 11 and the connective portions of each of the terminal connectors are electrically insulated from the rigid basket material by the use of insulating spacers or terminal bases which align and support the basket terminal connectors 28.

Electrodynamic motor structures 102, 104 may each include a magnetic circuit defined by a doughnut shaped or annular ring shaped planar front plate 30, which along with the pole piece 32 defines a magnetic gap to focus magnetic flux from magnet 36 across voice coil 26. A substantially planar and circular back plate 34 also provides part of the magnetic circuit, carries cylindrical pole piece 32 and provides structural support for magnet 36. An annular magnetic gap focusing the magnetic flux from magnet 36 is defined in the annular space between pole piece 32 and the circular opening in front plate 30. The annular gap has a radial extent sized to receive the voice coil former's thickness plus the voice coil's thickness to provide adequate clearance for the moving voice coil in the magnetic gap during operation. Each electrodynamic motor has, instead of a woofer cone, a reciprocating circular rigid coil cap member 1116 mounted via a flexible suspension (e.g., like annular spider member 22*a*) configured to align and support one end of camshaft 1130 and prevent twisting torque by a supporting the keyed camshaft end 1133 in a tightly fitted camshaft end receiving slot or aperture.

In the embodiment illustrated in FIGS. 17-20D, tubular housing 110 again defines a stationary support member which encloses a cylindrical chamber having a central axis, and the chamber is dimensioned to receive the moving components of the transducer assembly 1100. The tubular housing member's chamber is a lumen having a first open end 112 opposing a second open end 114. First linear reciprocating electrodynamic motor 102 (not shown in FIG. 17) is mounted over the tubular housing member's first open end 112 and is supported there by a substantially planar first spider-magnet mount 122. A second linear reciprocating electrodynamic motor 104 (not shown in FIG. 17) is mounted over the tubular housing member's second open end 114 and is supported there by a second substantially planar spider-magnet mount 122. Each of the linear reciprocating electrodynamic motors 102, 104 has a reciprocating voice coil which is readily energized to reciprocate the voice coil member to push or pull along the tubular housing member's central axis by driving the coil cap member 1116.

An elongate straight, rigid driveshaft 1130 is affixed between said first motor's voice coil driven cap member 1116 and said second motor's voice coil driven cap member 1116. The voice coils for the opposing drivers 102, 104 are wired out of phase, so that during a first excursion, said first motor's voice coil member is driven to push said first motor's voice coil member and said straight, rigid driveshaft 1130 toward said second motor's voice coil member, which is simultaneously driven to pull the driveshaft 1130, and in this manner, an alternating current signal fed to both linear reciprocating electrodynamic motors 102, 104 causes a reciprocating motion alternately pushing shaft 1130 away from said first motor's voice coil member and then pulling the shaft 1130 into or toward the first motor's voice coil member.

The transducer's opposing linear reciprocating electrodynamic motors 102, 104 when energized, drive the shaft 1130 which has at least one and preferably two transverse bores 1131. Each transverse pin-retaining transverse bore carries a rigidly fixed transversely projecting reciprocating force transmitting pin member 1132 which reciprocates linearly up and down a path parallel with the central axis, when driven. Transducer 1100 has a rotatable transducer cam-vane assembly 1200 with vanes 1210, 1212 carried on an axially aligned supporting cam sleeve member 1220 having an interior sleeve lumen 1222 within which is affixed worm drive sleeve insert member 1221 with inwardly projecting cam surfaces 1224 which engage the camshaft's external transversely projecting reciprocating force transmitting pin members 1132 and, as the camshaft 1130 is driven and reciprocates linearly, it imparts a rotating reciprocal motion to the cam surfaces 1224 within sleeve 1220 which in turn applies a controlled rotation force to each vane 1210, 1212.

Transducer 1100 also provides a low frequency, 0-320+ Hz (Cycles per second) bass pump designed to reproduce subsonic frequencies and up through the first 4 audible octaves (possibly more) in the human hearing range. Transducer 1100 is preferably mounted with one half (½) being within a sealed enclosure and affixed via the circumferential flange or center mounting support 380. In principal, transducer 1100 is also made up of two primary moving parts. The first moving part is the driveshaft 1130 which is retained in the central lumen 1222 of the cam-vane assembly 1200. The cam-vane assembly 1200 within the center of the tube housing is preferably configured to rotate on bearings and, when inserted into the housing's chamber, divides the tubular chamber into two sub-chamber volumes. As described above, within the tube housing's interior lumen the two stationary vanes 124, 126 split the tube's interior volume into two additional sub-chamber volumes giving it a total of 4 sub-chamber volumes. The shaft is inserted through the center of the wormgear sleeve 1221 and attached at both ends to the conventional speaker motors 102, 104 via the motor's voice-coil driven cap members 1116. As noted above, one speaker motor is connected reversed polarity to the other speaker motor to slide the camshaft in a push/pull motion back and forth through the center of the cam sleeve 1220 when the speaker motors are energized by an electrical signal.

The compact transducer 1100 of the present invention is configured in such a way that with every half of an inch (½ Inch) the shaft 1130 slides one way, sleeve 1220 will receive a transfer of force and energy from the pins and the transducer vanes rotate one direction 45 degrees. So when the camshaft is at center and slides down ½ inch, it transfers motion to the wormdrive 1221 and rotates the vane assembly from center "0" to 45 degrees, rotates in a first direction, whereby the two chambers in front of the moving vanes 1210, 1212 will define a volume of air that is squeezed or compressed while the two chambers behind the movement will increase in volume, and momentarily reduce pressure. In combination with vents on both the vent plates (302, 304) and on the exterior walls of the tube (P1, P2, P3 and P4), transducer 1100 compresses air into the sealed enclosure (e.g. 510, as illustrated in FIGS. 15 and 16), thus creating a rarefaction or moving vacuum region in the listening area as a reproduced sound wave.

More generally, for the embodiment of FIGS. 17-21B, rotary reciprocating acoustic transducer 1100 produces sound in response to an applied electrical signal, and includes a tubular housing 110 having a generally cylindrical chamber with an interior lumen defining a cylindrical sidewall terminating in a first open end 112 which opposes a second open end 114, and the tubular housing is a right circular cylinder being generally symmetrical about a central axis. Transducer 1100 has at least a first linear reciprocating electrodynamic motor 102 having a voice coil and mounted over the tubular housing member's first open end 112 with the first motor's voice coil member oriented inwardly, facing the lumen. Transducer 1100 also preferably includes a second linear reciprocating electrodynamic motor 104 having a voice coil member mounted over the tubular housing member's second open end with said second motor's voice coil member oriented inwardly, facing the lumen and the first motor, and an elongate rigid driveshaft 1130 is affixed between the first motor's voice coil member and the second motor's voice coil member, and carries at least one transversely projecting reciprocating force transmitting pin member 1132 which drives a rotatable transducer vane assembly 1200 which has an axially aligned wormdrive sleeve 1221 in a central sleeve lumen with inwardly projecting cam surfaces 1224 configured to rotatably engage said driveshaft's transversely projecting reciprocating force transmitting pin members.

The vane assembly 1200 further includes at least first and second rotating inclined vanes 1210, 1212 projecting radially away from the tubular central hub-like segment carrying the wormdrive sleeve 1221, and the driveshaft 1130 and the rotatable transducer vane assembly 1200 form a rotor assembly configured to rotatably fit within said chamber's interior lumen. As above, the tubular housing 110 has at least first and second inwardly projecting stationary vanes 124, 126 mounted in the chamber between the movable vanes 1210, 1212 and extending between the cylindrical sidewall and the wormdrive sleeve and between the end walls. The cylindrical chamber has at least first and second ports (P1-P4) opening through the walls of said cylindrical chamber to direct air flow into and out of the cylinder's interior lumen in response to rotary reciprocating movement of the movable vanes 1210, 1212, when driven by the first and second linear reciprocating electrodynamic motors which are coupled to the driveshaft 1130 and configured to simultaneously apply cooperating linear reciprocating movement to driveshaft 1130 so that the driveshaft's reciprocating force transmitting pin member 1132, while engaging the wormdrive sleeve 1221, provides rotational reciprocating movement to the rotor assembly 1200, through a selected excursion arc (e.g. 40-60 degrees) which is controlled by the reciprocating linear excursion of the first and second motor voice coil members. Optionally, vane assembly 1200 may include a third rotating vane for use in a housing having and a third stationary vane (not shown). The rotary reciprocating acoustic transducer's first rotating vane 1210 comprises a substantially rigid radially projecting fluid impermeable member having a first side opposing a second side and an axially aligned proximal edge opposing a helically inclined distal edge to provide opposing distal sweeping inclined surfaces. The first rotating vane preferably comprises a helically inclined surface having a selected pitch angle at said first rotating vane's distal edge, and the selected pitch angle at said vane's distal edge is selected to be between 10 and 30 degrees from a reference line parallel to the central axis. Preferably, the selected pitch angle at the vane's distal edge is 20 degrees from the vertical or from a line parallel to the central axis.

Preferably, the first stationary vane 124 comprises a substantially planar axially aligned inwardly projecting fluid impermeable wall segment having a no pitch angle at the stationary vane's inwardly projecting edge and first stationary vane 124 projects inwardly from said cylindrical chamber proximate first port opening P1 and a vent plate port 302 to direct air flow into and out of the cylinder's interior lumen in response to the rotary reciprocating movement of the vane assembly's first rotating vane.

While transducers 100 and 1100 as described above and illustrated in the Figures is characterized as a low frequency transducer or "bass pump" which provides a significant improvement over traditional woofers, the transducer configuration of the present invention is scalable such that smaller, faster versions may be configured to generate acoustic outputs in the traditional frequency ranges for "mid-range" drivers or high frequency drivers ("tweeters").

Having described preferred embodiments of a new and improved method, it is believed that other modifications, variations and changes will be suggested to those skilled in the art in view of the teachings set forth herein. It is therefore to be understood that all such variations, modifications and changes are believed to fall within the scope of the present invention as defined by the appended claims.

I claim:

1. A rotary reciprocating acoustic transducer for producing sound in response to an applied electrical signal, comprising:

(a) a tubular housing having a generally cylindrical chamber with an interior lumen defining a cylindrical sidewall terminating in a first open end which opposes a second open end, said tubular housing being generally symmetrical about a central axis;

(b) a first linear reciprocating electrodynamic motor having a voice coil member, said first motor being mounted over the tubular housing member's first open end with said first motor's voice coil member oriented inwardly, facing the lumen;

(c) a second linear reciprocating electrodynamic motor having a voice coil member, said second motor being mounted over the tubular housing member's second open end with said second motor's voice coil member oriented inwardly, facing the lumen and said first motor;

(d) an elongate rigid camshaft affixed between said first motor's voice coil member and said second motor's voice coil member, said camshaft carrying a radially projecting helical worm gear surface;

(e) a rotatable transducer vane assembly comprising an axially aligned cam sleeve having a central sleeve lumen with inwardly projecting cam surfaces configured to rotatably engage said camshaft's radially projecting helical worm gear surface;

(f) said vane assembly further including at least first and second rotating inclined vanes projecting radially away from said cam sleeve;

(g) said camshaft and said rotatable transducer vane assembly forming a rotor assembly configured to rotatably fit within said chamber's interior lumen, (h) said tubular housing having at least first and second inwardly projecting stationary vanes mounted in said chamber between said movable vanes and extending between said cylindrical sidewall and said cam sleeve and between said end walls, (i) said cylindrical chamber having at least first and second ports opening through the walls of said cylindrical chamber to direct air flow into and out of the cylinder's interior lumen in response to rotary reciprocating movement of the movable vanes, (j) wherein said first and second linear reciprocating electrodynamic motors, being coupled to the camshaft are configured to simultaneously apply cooperating linear reciprocating movement to said camshaft so that said camshaft, engaging said cam sleeve, provides rotational reciprocating movement to the rotor assembly, through a selected excursion arc which is controlled by the reciprocating linear excursion of the first and second motor voice coil members.

2. The rotary reciprocating acoustic transducer of claim 1, further comprising a third rotating vane on said rotating transducer vane assembly and a third stationary vane in said housing chamber.

3. The rotary reciprocating acoustic transducer of claim 1, wherein said first rotating vane comprises a substantially rigid radially projecting member having a first side opposing a second side and an axially aligned proximal edge opposing a helically inclined distal edge to provide opposing distal sweeping inclined surfaces.

4. The rotary reciprocating acoustic transducer of claim 3, wherein said first rotating vane comprises a helically inclined surface having a selected pitch angle at said first rotating vane's distal edge.

5. The rotary reciprocating acoustic transducer of claim 4, wherein said first rotating vane's selected pitch angle at said vane's distal edge is selected to be between 10 and 30 degrees from a reference line parallel to the central axis.

6. The rotary reciprocating acoustic transducer of claim 5, wherein said first rotating vane's selected pitch angle at said vane's distal edge is selected to be 20 degrees from the central axis.

7. The rotary reciprocating acoustic transducer of claim 3, wherein said first stationary vane comprises a substantially planar axially aligned inwardly projecting wall segment having a no pitch angle at said stationary vane's inwardly projecting edge; and wherein first stationary vane projects inwardly from said cylindrical chamber proximate said first port opening to direct air flow into and out of the cylinder's interior lumen in response to the rotary reciprocating movement of said first rotating vane.

8. A rotary reciprocating acoustic transducer for producing sound in response to an applied electrical signal, comprising:

(a) a tubular housing having a generally cylindrical chamber with an interior lumen defining a cylindrical sidewall terminating in a first open end which opposes a second open end, said tubular housing being generally symmetrical about a central axis, (b) a first linear reciprocating electrodynamic motor having a voice coil member, said first motor being mounted over the tubular housing member's first open end with said first motor's voice coil member oriented inwardly, facing the lumen;

(c) a second linear reciprocating electrodynamic motor having a voice coil member, said second motor being mounted over the tubular housing member's second open end with said second motor's voice coil member oriented inwardly, facing the lumen and said first motor;

(d) an elongate rigid driveshaft affixed between said first motor's voice coil member and said second motor's voice coil member, said driveshaft carrying at least one transversely projecting reciprocating force transmitting member;

(e) a rotatable transducer vane assembly comprising an axially aligned wormdrive sleeve having a central sleeve lumen with inwardly projecting cam surfaces configured to rotatably engage said driveshaft's transversely projecting reciprocating force transmitting member;

(f) said vane assembly further including at least first and second rotating inclined vanes projecting radially away from said wormdrive sleeve;

(g) said driveshaft and said rotatable transducer vane assembly forming a rotor assembly configured to rotatably fit within said chamber's interior lumen, (h) said tubular housing having at least first and second inwardly projecting stationary vanes mounted in said chamber between said movable vanes and extending between said cylindrical sidewall and said wormdrive sleeve and between said end walls, (i) said cylindrical chamber having at least first and second ports opening through the walls of said cylindrical chamber to direct air flow into and out of the cylinder's interior lumen in response to rotary reciprocating movement of the movable vanes, (k) wherein said first and second linear reciprocating electrodynamic motors, being coupled to the driveshaft are configured to simultaneously apply cooperating linear reciprocating movement to said driveshaft so that said driveshaft's reciprocating force transmitting member, while engaging said wormdrive sleeve, provides rotational reciprocating movement to the rotor assembly, through a selected excursion arc which is controlled by the reciprocating linear excursion of the first and second motor voice coil members.

9. The rotary reciprocating acoustic transducer of claim 8, further comprising a third rotating vane and a third stationary vane.

10. The rotary reciprocating acoustic transducer of claim 8, wherein said first rotating vane comprises a substantially rigid radially projecting member having a first side opposing a second side and an axially aligned proximal edge opposing a helically inclined distal edge to provide opposing distal sweeping inclined surfaces.

11. The rotary reciprocating acoustic transducer of claim 10, wherein said first rotating vane comprises a helically inclined surface having a selected pitch angle at said first rotating vane's distal edge.

12. The rotary reciprocating acoustic transducer of claim 11, wherein said first rotating vane's selected pitch angle at said vane's distal edge is selected to be between 10 and 30 degrees from the central axis.

13. The rotary reciprocating acoustic transducer of claim 12, wherein said first rotating vane's selected pitch angle at said vane's distal edge is selected to be 20 degrees from the central axis.

14. The rotary reciprocating acoustic transducer of claim 10, wherein said first stationary vane comprises a substantially planar axially aligned inwardly projecting wall segment having a no pitch angle at said stationary vane's inwardly projecting edge; and wherein first stationary vane projects inwardly from said cylindrical chamber proximate said first port opening to direct air flow into and out of the cylinder's interior lumen in response to the rotary reciprocating movement of said first rotating vane.

15. A rotary reciprocating bass-pump loudspeaker system, comprising:

(a) a loudspeaker enclosure having a selected interior volume and an opening configured to receive a flanged tubular housing;

(b) a tubular housing having a generally cylindrical chamber with an interior lumen defining a cylindrical sidewall terminating in a first open end which opposes a second open end, said tubular housing being generally symmetrical about a central axis, said tubular housing having an exterior sidewall carrying a circumferential flange, (c) a first linear reciprocating electrodynamic motor having a voice coil member, said first motor being mounted over the tubular housing member's first open end with said first motor's voice coil member oriented inwardly, facing the lumen;

(d) a second linear reciprocating electrodynamic motor having a voice coil member, said second motor being mounted over the tubular housing member's second open end with said second motor's voice coil member oriented inwardly, facing the lumen and said first motor;

(e) an elongate rigid reciprocating shaft affixed between said first motor's voice coil member and said second motor's voice coil member, said shaft carrying a radially projecting reciprocating force transmitting surface;

(f) a rotatable transducer vane assembly comprising an axially aligned cam sleeve having a central sleeve lumen with inwardly projecting cam surfaces configured to rotatably engage said camshaft's radially projecting surface;

(g) said vane assembly further including at least first and second rotating vanes projecting radially away from said cam sleeve;

(h) said reciprocating shaft and said rotatable transducer vane assembly forming a rotor assembly configured to rotatably fit within said chamber's interior lumen, (i) said tubular housing having at least first and second inwardly stationary vanes mounted in said chamber between said movable vanes and extending between said cylindrical sidewall and said cam sleeve and between said end walls, (j) said cylindrical chamber having at least first and second ports opening through the walls of said cylindrical chamber to direct air flow into and out of the cylinder in response to movement of the movable vanes, (k) wherein said first and second linear reciprocating electrodynamic motors, being coupled to the reciprocating shaft are configured to simultaneously apply cooperating linear reciprocating movement to said reciprocating shaft so that said shaft, engaging said cam sleeve, provides rotational reciprocating movement to the rotor assembly, through a selected excursion arc which is controlled by the linear excursion of the first and second motor voice coil members.

16. The rotary reciprocating bass-pump loudspeaker system of claim 15, wherein said first rotating vane comprises a substantially rigid radially projecting member having a first side opposing a second side and an axially aligned proximal edge opposing a helically inclined distal edge to provide opposing distal sweeping inclined surfaces.

17. The rotary reciprocating bass-pump loudspeaker system of claim 15, wherein said first rotating vane comprises a helically inclined surface having a selected pitch angle at said first rotating vane's distal edge.

18. The rotary reciprocating bass-pump loudspeaker system of claim 17, wherein said first rotating vane's selected pitch angle at said vane's distal edge is selected to be between 10 and 30 degrees from the central axis.

19. The rotary reciprocating bass-pump loudspeaker system claim 18, wherein said first rotating vane's selected pitch angle at said vane's distal edge is selected to be 20 degrees from the central axis.

20. The rotary reciprocating acoustic transducer of claim 18, wherein said first stationary vane comprises a substantially planar axially aligned inwardly projecting wall segment having a no pitch angle at said stationary vane's inwardly projecting edge; and wherein first stationary vane projects inwardly from said cylindrical chamber proximate said first port opening to direct air flow into and out of the cylinder's interior lumen in response to the rotary reciprocating movement of said first rotating vane.

* * * * *